US007826776B2

(12) United States Patent
Tsuda et al.

(10) Patent No.: US 7,826,776 B2
(45) Date of Patent: Nov. 2, 2010

(54) DEVELOPMENT APPARATUS AND IMAGE FORMING APPARATUS EMPLOYING THE SAME

(75) Inventors: Kiyonori Tsuda, Kanagawa (JP); Satoru Yoshida, Kanagawa (JP); Hiroya Hirose, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 897 days.

(21) Appl. No.: 11/612,865

(22) Filed: Dec. 19, 2006

(65) Prior Publication Data

US 2007/0264054 A1 Nov. 15, 2007

(30) Foreign Application Priority Data

Dec. 20, 2005 (JP) ..... 2005-366218
Feb. 28, 2006 (JP) ..... 2006-053974

(51) Int. Cl.
*G03G 15/08* (2006.01)

(52) U.S. Cl. ..... 399/255; 399/254; 399/258

(58) Field of Classification Search ..... 399/254–256, 399/258, 260, 272, 273
See application file for complete search history.

(56) References Cited

U.S. PATENT DOCUMENTS 5,659,860 A 8/1997 Sasaki et al.
5,758,241 A 5/1998 Oyama et al.
5,771,426 A 6/1998 Oka et al.
5,771,429 A 6/1998 Oyama et al.
5,805,965 A 9/1998 Tsuda et al.
5,822,664 A 10/1998 Oka et al.
5,915,155 A 6/1999 Shoji et al.
6,035,168 A * 3/2000 Masuda et al. ..... 399/254
6,125,243 A 9/2000 Shoji et al.

(Continued)

FOREIGN PATENT DOCUMENTS

JP 7-13424 1/1995

(Continued)

OTHER PUBLICATIONS

Machine Translation of Miyasaka et al. (JP Pub No. 2001-290,368, listed in IDS).*
U.S. Appl. No. 12/015,803, filed Jan. 17, 2008, Hirose.
U.S. Appl. No. 12/019,984, filed Jan. 25, 2008, Tsuda, et al.
U.S. Appl. No. 12/020,172, filed Jan. 25, 2008, Tsuda, et al.

(Continued)

*Primary Examiner*—David M Gray
*Assistant Examiner*—Rodney Bonnette
(74) *Attorney, Agent, or Firm*—Oblon, Spivak, McClelland, Maier & Neustadt, L.L.P.

(57) ABSTRACT

A development apparatus includes three developer conveyance paths with separate functions for the supply, recovery and agitation of a developer, respectively, in which a reduction in size of the apparatus can be achieved. An image forming apparatus includes the development apparatus. By a development region width of a supply opening for delivering developer from a downstream end in the direction of conveyance of an agitation conveyance path to an upstream end in the direction of conveyance of a supply conveyance path and a surplus opening for delivering developer from the downstream end in the direction of conveyance of the supply conveyance path to the upstream end in the direction of conveyance of the agitation conveyance path, a space saving of the upper part of the development apparatus can be achieved and a space saving of the development apparatus as a whole can be achieved compared with a conventional development apparatus.

13 Claims, 12 Drawing Sheets

U.S. PATENT DOCUMENTS

| | | | | |
|---|---|---|---|---|
| 6,198,895 | B1 | 3/2001 | Tsuda et al. | |
| 6,337,957 | B1 | 1/2002 | Tamaki et al. | |
| 6,522,855 | B1 | 2/2003 | Katoh et al. | |
| 7,024,133 | B2 | 4/2006 | Nagashima et al. | |
| 7,076,192 | B2 | 7/2006 | Tsuda et al. | |
| 7,136,610 | B2 | 11/2006 | Arai et al. | |
| 7,313,348 | B2 * | 12/2007 | Hart et al. | 399/256 |
| 2004/0096239 | A1 | 5/2004 | Hosokawa et al. | |
| 2004/0223790 | A1 | 11/2004 | Hosokawa et al. | |
| 2005/0226656 | A1 | 10/2005 | Tsuda et al. | |
| 2005/0281590 | A1 | 12/2005 | Tsuda et al. | |
| 2006/0051136 | A1 | 3/2006 | Tsuda et al. | |
| 2006/0083555 | A1 | 4/2006 | Uchiyama et al. | |
| 2006/0099012 | A1 | 5/2006 | Kita et al. | |

FOREIGN PATENT DOCUMENTS

| | | | |
|---|---|---|---|
| JP | 9-146355 | | 6/1997 |
| JP | 10-123817 | | 5/1998 |
| JP | 2001-290368 | | 10/2001 |
| JP | 2002-251070 | | 9/2002 |
| JP | 2003-263012 | | 9/2003 |
| JP | 2003-307924 | | 10/2003 |
| JP | 2004077587 | A * | 3/2004 |
| JP | 2004-258237 | | 9/2004 |

OTHER PUBLICATIONS

U.S. Appl. No. 12/042,848, filed Mar. 5, 2008, Kita, et al.
U.S. Appl. No. 12/110,055, filed Apr. 25, 2008, Sakata, et al.
U.S. Appl. No. 11/750,746, filed May 18, 2007, Hirose, et al.
U.S. Appl. No. 11/836,298, filed Aug. 9, 2007, Tsuda, et al.
U.S. Appl. No. 11/853,490, filed Sep. 11, 2007, Miyamoto, et al.
U.S. Appl. No. 12/238,815, filed Sep. 26, 2008, Utsunomiya, et al.
U.S. Appl. No. 12/250,046, filed Oct. 13, 2008, Tsuda.
U.S. Appl. No. 11/867,425, filed Oct. 4, 2007, Yoshida.

* cited by examiner

DEVELOPMENT APPARATUS AND IMAGE FORMING APPARATUS EMPLOYING THE SAME

BACKGROUND OF THE INVENTION

1. Field of the Invention

The present invention relates to an electrophotographic image forming apparatus such as a copier, facsimile device or printer, and more particularly to a development apparatus that employs a two-component developer comprising a toner and a magnetic carrier and an image forming apparatus employing the same.

2. Description of the Related Art

In conventionally known development apparatuses in which a two-component developer is employed the developer is circulated by, while the developer is conveyed in the width direction of a developer carrier, the provision of a supply conveyance path for supplying the developer to the developer carrier, and an agitation carrier path for agitating the developer while conveying it in the reverse direction to the supply conveyance path. In development apparatuses such as this, when recovery developer that has been supplied to the developer carrier has passed through the development region is recovered in the supply conveyance path, a mixing of the developer that has passed through the development region from which toner has been consumed and the developer in the supply conveyance path in the supply conveyance path occurs. There is a problem associated therewith in that, because the quantity of developer that has passed through the development region increases toward the downstream side of the supply conveyance path, the toner density of the developer supplied to the developer carrier drops toward the downstream side in the direction of conveyance of the supply conveyance path. A drop in the toner density of the developer supplied to the developer carrier results in a drop in the image density during development and, accordingly, irregularities in image density in which the image density between the upstream side and the downstream side in the direction of conveyance of the conveyance path for supplying developer to the developer carrier differs.

On the other hand, when recovery developer is recovered in the agitation conveyance path, the greater the amount of developer recovered at the downstream side in the direction of conveyance of the agitation conveyance path the shorter the agitation time. Because the developer that has arrived at the end part on the downstream side in the direction of conveyance of the agitation conveyance path is delivered to the end part on the upstream side in the direction of conveyance of the supply conveyance path, the developer recovered on the downstream side in the direction of conveyance of the agitation conveyance path is immediately supplied to the supply conveyance path. As a result, even if a replenishment of the toner is performed to maintain a suitable toner density in accordance with the output image, problems of non-uniformity of image density and a drop in image density and so on occur due to inadequate agitation of the developer and non-uniformity of the toner charge amount.

Problems such as these that have their origin in the recovery of the recovery developer in the supply conveyance path or agitation conveyance path can be resolved by, as in the development apparatus described in Japanese Unexamined Patent Application No. H11-167260, the provision of a recovery conveyance path for recovery of the recovery developer separate to the supply conveyance path and agitation conveyance path. This development apparatus comprises a supply conveyance path for, while a developer is being conveyed, supplying it to a developer carrier, and a recovery conveyance path for recovering a recovery developer while conveying it in the same direction as the supply conveyance path. The development apparatus further comprises an agitation conveyance path for agitating surplus developer that has arrived at the downstream end in the direction of conveyance of the supply conveyance path and the recovery developer that has arrived at the downstream end in the direction of conveyance of the recovery conveyance path. The supply conveyance path, recovery conveyance path and agitation conveyance path are each partitioned by partition members. An opening through which the agitated developer is delivered to the supply conveyance path is provided in a partition member with the supply conveyance path at the end part on the downstream side of the agitation conveyance path. In addition, an opening through which the surplus developer is delivered to the agitation conveyance path is provided in a partition member with the agitation conveyance path at the end part on the downstream side of the supply conveyance path, and an opening through which recovery developer is delivered to the agitation conveyance path is provided in a partition member with the agitation conveyance path at the end part on the downstream side of the recovery conveyance path.

By implementing the functions of supply and recovery of the developer to the developer carrier separately in this way, the toner density of the developer supplied to the developer carrier can be made constant and a generation of density irregularities can be prevented. In addition, by implementing the functions of agitation and recovery of the developer separately, thorough agitation of the developer is possible and image density can be stabilized.

In a conventional development apparatus comprising three separate developer conveyance paths for supply, recovery and agitation of the developer, the openings through which the supply conveyance path is linked with the agitation conveyance path at the end part on the upstream side and the end part on the downstream side of the supply conveyance path are provided on the outer side of a development region width which refers to the width of the development region in which a developer carrier supplies toner to a latent image carrier. Accordingly, the length in the direction of conveyance of at least the supply conveyance path and agitation conveyance path is longer than the developer carrier by the length occupied by these openings and the apparatus is increased in size to that extent.

In addition, in a conventional apparatus comprising separate developer conveyance paths for supply, recovery and agitation of the developer, the opening through which the agitation conveyance path is linked with the end part on the downstream side of the recovery conveyance path is provided on the outer side of the width in the axial direction of the developer carrier. Accordingly, the length in the direction of conveyance of at least the recovery conveyance path and agitation conveyance path is longer than the developer carrier by the length occupied by this opening and the apparatus is increased in size to that extent.

Furthermore, in a conventional apparatus comprising separate developer conveyance paths for supply, recovery and agitation of the developer, a toner replenishment port for replenishing toner to the developer conveyance path is provided on the outer side of the width in the axial direction of the developer carrier. Accordingly, the length in the direction of conveyance of at least the developer conveyance path comprising the toner replenishment port of the developer conveyance paths is longer than the developer carrier by the length occupied by this toner replenishment port and the apparatus is increased in size to that extent.

Technologies relating to the present invention are disclosed in, e.g.,

Japanese Unexamined Patent Application No. H07-013424

Japanese Unexamined Patent Application No. H10-123817 and

Japanese Unexamined Patent Application No. 2001-290368

SUMMARY OF THE INVENTION

It is an object of the present invention to provide a development apparatus comprising three developer conveyance paths with separate functions for the supply, recovery and agitation of the developer in which a reduction in size of the apparatus can be achieved, and an image forming apparatus comprising the same.

Another object of the present invention is to provide a development apparatus comprising developer conveyance paths with separate functions for the supply, recovery and agitation of the developer in which a reduction in size of the device can be achieved, and an image forming apparatus comprising the same.

In an aspect of the present invention, a development apparatus comprises a developer carrier that rotates with a two-component developer comprising a magnetic carrier and toner carried on its surface to supply toner for developing a latent image on the surface of a latent image carrier at a location opposing the latent image carrier; a developer supply conveyance path which conveys the two-component developer along the axial direction of the developer carrier, and which comprises a developer supply conveyance member for supplying the two-component developer to the developer carrier; a developer recovery conveyance path comprising a developer recovery conveyance member for conveying the two-component developer recovered from the developer carrier after having passed through a location opposing the latent image carrier, along the axial direction of the developer carrier and in the same direction as the developer supply conveyance member; and a developer agitation conveyance path to which a surplus developer not employed for development and conveyed to the furthermost downstream side in the direction of conveyance of the developer supply conveyance path and a recovery developer recovered from the developer carrier and conveyed to the furthermost downstream side in the direction of conveyance of the developer recovery conveyance path are supplied, and which comprises a developer agitation conveyance member for, while agitating said surplus developer and the recovery developer, conveying the surplus developer and the recovery developer along the axial direction of the developer carrier in the reverse direction to the developer supply conveyance member to supply an agitated agitation developer to the developer supply conveyance path. Three developer conveyance paths constituted by the developer recovery conveyance path, the developer supply conveyance path and the developer agitation conveyance path are partitioned by respective partition members and toner is being replenished to the developer conveyance paths. At least one of an opening of the partition member on the downstream side in the direction of conveyance of the developer supply conveyance path with the developer agitation conveyance path, through which the surplus developer is delivered, and an opening of the partition member on the downstream side in the direction of conveyance of the developer agitation conveyance path with the developer supply conveyance path, through which the gitation developer is delivered, is provided within a development region width which constitutes the width in the axial direction of a development region in which the developer carrier supplies toner to the latent image carrier.

In another aspect of the present invention, a development apparatus comprises a developer carrier that rotates with a two-component developer comprising a magnetic carrier and toner carried on its surface to supply toner for developing a latent image on the surface of a latent image carrier at a location opposing the latent image carrier; a developer supply conveyance path which conveys the two-component developer along the axial direction of the developer carrier, and which comprises a developer supply conveyance member for supplying the two-component developer to the developer carrier; a developer recovery conveyance path comprising a developer recovery conveyance member for conveying the two-component developer recovered from the developer carrier after having passed through a location opposing the latent image carrier in the axial direction of the developer carrier; a developer agitation conveyance path to which a surplus developer not employed for development and conveyed to the furthermost downstream side in the direction of conveyance of the developer supply conveyance path and a recovery developer recovered from the developer carrier and conveyed to the furthermost downstream side in the direction of conveyance of the developer recovery conveyance path are supplied, and which comprises a developer agitation conveyance member for, while agitating the surplus developer and the recovery developer, conveying the surplus developer and the recovery developer in the axial direction of the developer carrier to supply an agitated agitation developer to the developer supply conveyance path. The developer recovery conveyance path, the developer supply conveyance path and the developer agitation conveyance path serving as developer conveyance paths are partitioned by respective partition members and toner is replenished to the developer conveyance paths. An opening of the partition member on the downstream side in the direction of conveyance of the developer recovery conveyance path with the developer agitation conveyance path, through which the recovery developer is delivered, is provided in the inner side of the width in the axial direction of the developer carrier.

In another aspect of the present invention, a development apparatus comprises a developer carrier that rotates with a two-component developer comprising a magnetic carrier and toner carried on its surface to supply toner for developing a latent image on the surface of a latent image carrier at a location opposing the latent image carrier; a developer supply conveyance path which conveys the two-component developer along the axial direction of the developer carrier, and which comprises a developer supply conveyance member for supplying the two-component developer to the developer carrier; a developer recovery conveyance path comprising a developer recovery conveyance member for conveying the two-component developer recovered from the developer carrier after having passed through a location opposing the latent image carrier in the axial direction of the developer carrier; a developer agitation conveyance path to which a surplus developer not employed for development and conveyed to the furthermost downstream side in the direction of conveyance of the developer supply conveyance path and a recovery developer recovered from the developer carrier and conveyed to the furthermost downstream side in the direction of conveyance of the developer recovery conveyance path are supplied, and which comprises a developer agitation conveyance member for, while agitating the surplus developer and the recovery developer, conveying the surplus developer and the recovery developer in the axial direction of the developer carrier to supply an agitated agitation developer to the developer supply conveyance path. The developer recovery conveyance path, the developer supply conveyance path and the developer agitation conveyance path serving as developer conveyance paths are partitioned by respective partition members and toner is replenished to the developer conveyance paths. A toner replenishment port for replenishing toner to the developer conveyance paths is provided in the inner side of the width in the axial direction of the developer carrier.

In another aspect of the image forming apparatus comprises at least a latent image carrier; a charging device for charging the surface of the latent image carrier; a latent image forming device for forming an electrostatic latent image on the image carrier; and a development device for developing the electrostatic latent image to produce a toner image. The development means comprises a developer carrier that rotates with a two-component developer comprising a magnetic carrier and toner carried on its surface to supply toner for developing a latent image on the surface of the latent image carrier at a location opposing the latent image carrier; a developer supply conveyance path which conveys the two-component developer along the axial direction of the developer carrier, and which comprises a developer supply conveyance member for supplying the two-component developer to said developer carrier. A developer recovery conveyance path comprises a developer recovery conveyance member for conveying the two-component developer recovered from the developer carrier after having passed through a location opposing the latent image carrier, along the axial direction of the developer carrier and in the same direction as the developer supply conveyance member; and a developer agitation conveyance path to which a surplus developer not employed for development and conveyed to the furthermost downstream side in the direction of conveyance of the developer supply conveyance path and a recovery developer recovered from the developer carrier and conveyed to the furthermost downstream side in the direction of conveyance of the developer recovery conveyance path are supplied, and which comprises a developer agitation conveyance member for, while agitating the surplus developer and the recovery developer, conveying the surplus developer and the recovery developer along the axial direction of the developer carrier in the reverse direction to the developer supply conveyance member to supply an agitated agitation developer to the developer supply conveyance path. Three developer conveyance paths constituted by the developer recovery conveyance path, the developer supply conveyance path and the developer agitation conveyance path are partitioned by respective partition members and toner being replenished to the developer conveyance paths. At least one of an opening of the partition member on the downstream side in the direction of conveyance of the developer supply conveyance path with the developer agitation conveyance path, through which the surplus developer is delivered, and an opening of the partition member on the downstream side in the direction of conveyance of the developer agitation conveyance path with the developer supply conveyance path, through which the agitation developer is delivered, is provided within a development region width which constitutes the width in the axial direction of a development region in which the developer carrier supplies toner to the latent image carrier.

In another aspect of the present invention, an image forming apparatus comprises at least a latent image carrier; a charging device for charging the surface of the latent image carrier; a latent image forming device for forming an electrostatic latent image on the image carrier; and a development device for developing the electrostatic latent image to produce a toner image. The development means comprises a developer carrier that rotates with a two-component developer comprising a magnetic carrier and toner carried on its surface to supply toner for developing a latent image on the surface of the latent image carrier at a location opposing the latent image carrier; a developer supply conveyance path which conveys the two-component developer along the axial direction of the developer carrier, and which comprises a developer supply conveyance member for supplying the two-component developer to the developer carrier; a developer recovery conveyance path comprising a developer recovery conveyance member for conveying the two-component developer recovered from the developer carrier after having passed through a location opposing said latent image carrier in the axial direction of the developer carrier; a developer agitation conveyance path to which a surplus developer not employed for development and conveyed to the furthermost downstream side in the direction of conveyance of the developer supply conveyance path and a recovery developer recovered from the developer carrier and conveyed to the furthermost downstream side in the direction of conveyance of the developer recovery conveyance path are supplied, and which comprises a developer agitation conveyance member for, while agitating the surplus developer and the recovery developer, conveying the surplus developer and the recovery developer in the axial direction of the developer carrier to supply an agitated agitation developer to the developer supply conveyance path. The developer recovery conveyance path, the developer supply conveyance path and the developer agitation conveyance path serving as developer conveyance paths are partitioned by respective partition members and toner is replenished to the developer conveyance paths. An opening of the partition member on the downstream side in the direction of conveyance of the developer recovery conveyance path with the developer agitation conveyance path, through which the recovery developer is delivered, is provided in the inner side of the width in the axial direction of the developer carrier.

In another aspect of the present invention, an image forming apparatus comprises at least a latent image carrier; a charging device for charging the surface of the latent image carrier; a latent image forming device for forming an electrostatic latent image on the image carrier; and a development device for developing the electrostatic latent image to produce a toner image. The development means comprises a developer carrier that rotates with a two-component developer comprising a magnetic carrier and toner carried on its surface to supply toner for developing a latent image on the surface of the latent image carrier at a location opposing the latent image carrier; a developer supply conveyance path which conveys the two-component developer along the axial direction of the developer carrier, and which comprises a developer supply conveyance member for supplying the two-component developer to the developer carrier; a developer recovery conveyance path comprising a developer recovery conveyance member for conveying the two-component developer recovered from the developer carrier after having passed through a location opposing the latent image carrier in the axial direction of the developer carrier; a developer agitation conveyance path to which a surplus developer not employed for development and conveyed to the furthermost downstream side in the direction of conveyance of the developer supply conveyance path and a recovery developer recovered from the developer carrier and conveyed to the furthermost downstream side in the direction of conveyance of the developer recovery conveyance path are supplied, and which comprises a developer agitation conveyance member for, while agitating the surplus developer and the recovery developer, conveying the surplus developer and the recovery developer in the axial direction of the developer carrier to supply an agitated agitation developer to the developer supply conveyance path. The developer recovery conveyance path, the developer supply conveyance path and the developer agitation conveyance path serving as developer conveyance paths are partitioned by respective partition members and toner is replenished to the developer conveyance paths. A toner replenishment port for replenishing toner to the developer conveyance paths is provided in the inner side of the width in the axial direction of the developer carrier.

BRIEF DESCRIPTION OF THE DRAWINGS

The above and other objects, features and advances of the present invention will become more apparent from the following detailed description based on the accompanying drawings in which.

DESCRIPTION OF THE PREFERRED EMBODIMENTS

A tandem-type color laser copier (hereinafter referred to simply as "copier") serving as one embodiment of an image forming apparatus in which the present invention has application and in which a plurality of photosensitive bodies are arranged in parallel will be hereinafter described.

Figure 1:
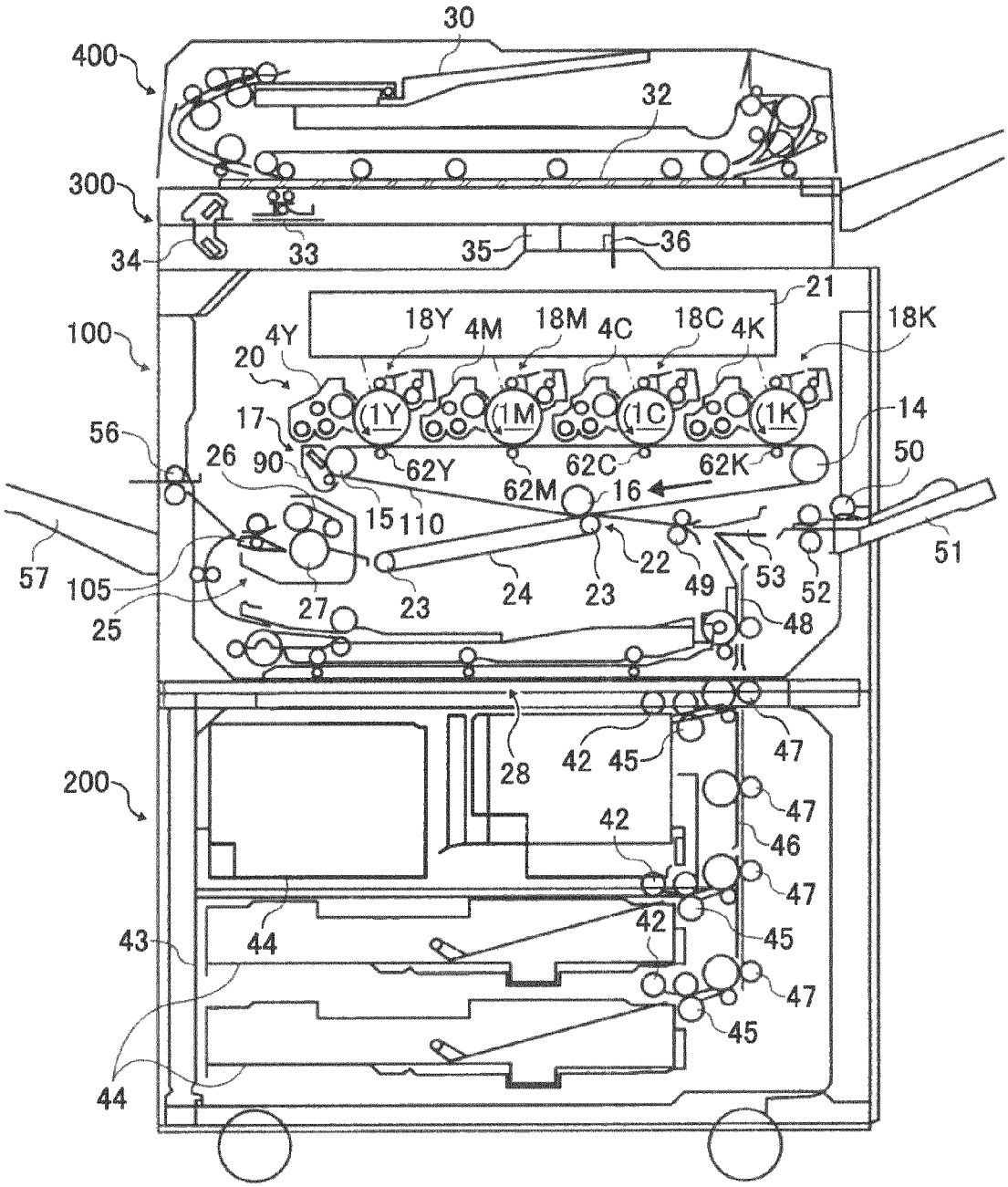
FIG. 1 is a diagram showing the schematic configuration of a copier pertaining to one embodiment of the present invention.

FIG. 1 shows the schematic configuration of the copier pertaining to this embodiment. The copier comprises a printer unit 100 and a paper feed device 200 on which this is provided, along with a scanner 300 that is fixed to the top of the printer unit 100 and so on. The copier further comprises an original document auto-conveying device 400 that is fixed on top of the scanner 300 and so on.

The printer unit 100 comprises an image forming unit 20 configured from four process cartridges 18Y, M, C, K for forming images of each of the colors of yellow (Y), magenta (M), cyan (C) and black (K). The Y, M, C, K assigned to this number symbol denote yellow, cyan, magenta and black (hereinafter this the same) members. In addition to the process cartridges 18Y, M, C, K, an optical write unit 21, intermediate transfer unit 17, secondary transfer device 22, resist roller pair 49 and belt-fixing system fixing device 25 and so on are arranged therein.

The optical write unit 21 comprises a light source, polygon mirror, f-θ lens and reflecting mirror and so on not shown in the diagram and irradiates a laser light onto the surface of later-described photosensitive bodies in accordance with image data.

The process cartridges 18Y, M, C, K comprise a drum-like photosensitive body 1, a charger, a development apparatus 4, a drum-cleaning device, and a decharger.

The process cartridge 18 for yellow will be hereinafter described.

A charger serving as charging means uniformly charges the surface of a photosensitive body 1Y. A laser light modulated and polarized by the optical write unit 21 is irradiated onto the surface of the photosensitive body 1Y on which a charge processing has been administered. Subsequently, an attenuation of the electric potential of the irradiated part (exposure part) occurs. As a result of this attenuation a Y electrostatic latent image is formed on the surface of the photosensitive body 1Y. The Y electrostatic latent image that is formed is developed to form a Y toner image by a development apparatus 4Y that constitutes development means.

The Y toner image formed on the Y photosensitive body 1Y is primary transferred onto a later-described intermediate transfer belt 110. The drum-cleaning device cleans the residual transfer toner on the surface of the photosensitive body 1Y that remains following primary transfer.

The decharger decharges the photosensitive body 1Y cleaned by the drum-cleaning device of the Y process cartridge 18Y. Thereupon, subsequent to uniform charging by the charger, it is restored to its original state. This same series of processes as described above is also carried out in the other process cartridges (18M, C, K).

The intermediate transfer unit will be hereinafter described.

The intermediate transfer unit 17 comprises an intermediate transfer belt 110 and belt-cleaning device 90 and so on. It further comprises a tension roller 14, drive roller 15, secondary transfer back-up roller 16 and four primary transfer bias rollers 62Y, M, C, K and so on.

The intermediate transfer belt 110 is tensioned by a plurality of rollers including the tension roller 14. It is continuously moved in the clockwise direction in the diagram by rotation of the drive roller 15 driven by a belt drive motor not shown in the diagram.

Each of the four primary transfer bias rollers 62Y, M, C, K are arranged to contact the inner circumferential surface side of the intermediate transfer belt 110 and are imparted with a primary transfer bias from a power source not shown in the diagram. In addition, the intermediate transfer belt 110 is pressed toward the photosensitive bodies 1Y, M, C, K from the inner circumferential surface side thereof forming respective primary transfer nips. A primary transfer electric field is formed in each primary transfer nip between the photosensitive bodies and the primary transfer bias rollers due to the effect of the primary transfer bias.

The Y toner image described above formed on the Y photosensitive body 1Y is primary transferred onto the intermediate transfer belt 110 due to the effect of this primary transfer electric field and nip pressure. The M, C, K toner images formed on the M, C, K photosensitive bodies 1M, C, K are superposingly primary transferred in sequence onto the Y toner image. As a result of this superposed primary transfer, a 4-color superposed toner image (hereinafter referred to as a 4-color toner image) that constitutes a multiple toner image is formed on the intermediate transfer belt 110.

The 4-color toner image superposingly transferred onto the intermediate transfer belt 110 is secondary transferred by a later-described secondary transfer nip onto a transfer paper not shown in the diagram which serves as the recording sheet. The residual transfer toner remaining on the surface of the intermediate transfer belt 110 after it has passed through the secondary transfer nip is cleaned by the belt-cleaning device 90 between the drive roller 15 in the left side of the diagram and which the belt is sandwiched.

The secondary transfer device 22 will be hereinafter described.

The secondary transfer device 22 in which a paper-conveying belt 24 is tensioned by two tension rollers 23 is arranged below the intermediate transfer unit 17 in the diagram. The paper-conveying belt 24 is continuously moved in the anti-clockwise direction in the diagram accompanying the rotational drive of at least one of the tension rollers 23. The intermediate transfer belt 110 and paper-conveying belt 24 are sandwiched between the roller of the two tension rollers 23 arranged in the left side in the diagram and the secondary transfer back-up roller 16 of the intermediate transfer unit 17. This sandwiching forms a secondary transfer nip in which the intermediate transfer belt 110 of the intermediate transfer unit 17 and the paper-conveying belt 24 of the secondary transfer device 22 are in contact. A secondary transfer bias of reverse polarity to the toner is imparted to this first tension roller 23 by a power source not shown in the diagram. The imparted secondary transfer bias forms a secondary transfer electric field for electrostatically moving the 4-color toner image on the intermediate transfer belt 110 of the intermediate transfer unit 17 from the belt side toward this first tension roller 23 in the secondary transfer nip. The 4-color toner image subject to the effect of this secondary transfer electric field and nip pressure is secondary transferred onto a transfer paper that is fed by the later-described resist roller pair 49 into the secondary transfer nip in synchronization with the 4-color toner image on the intermediate transfer belt 110. Replacing a secondary transfer system in which a secondary transfer bias is imparted to one of the tension rollers 23 in this way, a charger for non-contactably charging the transfer paper may be provided.

A plurality of paper feed cassettes 44 in which a plurality of sheets of transfer paper are housable in a ream state are arranged in an overlaid arrangement in the vertical direction in the inner part of the paper feed device 200 which is provided in the lower part of the copier main body. Each of the paper feed cassettes 44 push a paper feed roller 42 against the uppermost transfer paper of the ream. The uppermost transfer paper is fed out toward a paper feed path 46 by rotation of the paper feed roller 42.

The paper feed path 46 for receiving the transfer paper fed out from the paper feed cassette 44 comprises a plurality of conveyance roller pairs 47 and a resist roller pair 49 provided in proximity of the extremity of the path. The transfer paper is conveyed toward the resist roller pair 49. The transfer paper conveyed to the resist roller pair 49 is sandwiched between the rollers of the resist roller pair 49. Meanwhile, in the intermediate transfer unit 17, the 4-color toner image formed on the intermediate transfer belt 110 enters the secondary transfer nip accompanying continuous movement of the belt. The resist roller pair 49 feeds out the transfer paper sandwiched between the rollers at a timing that ensures close contact with the 4-color toner image at the secondary transfer nip. As a result, the 4-color toner image on the intermediate transfer belt 110 comes into close contact with the transfer paper at the secondary transfer nip. Thereupon, it is secondary transferred onto the transfer paper to form, on the white transfer paper, a full color image. The transfer paper on which the full color image has been formed in this way exits the secondary transfer nip accompanying the continuous movement of the paper-conveying belt 24 and is then fed from the paper-conveying belt 24 to the fixing device 25.

The fixing device 25 comprises a belt unit for continuously moving a fixing belt 26 while tensioning it between two rollers, and a pressuring roller 27 that is pressed toward one of the rollers of the belt unit. The fixing belt 26 and pressuring roller 27 abut to form a fixing nip between which the transfer paper received from the paper-conveying belt 24 is sandwiched. The roller of the two rollers of this belt unit pressed by the pressuring roller 27 comprises a heating source not shown in the diagram in its inner part, the fixing belt 26 being pressurized by the heat emitted therefrom. The pressured fixing belt 26 heats the transfer paper sandwiched in the fixing nip. The full color image is fixed to the transfer paper due to the effect of this heat and the nip pressure.

The transfer paper on which this fixing processing has been administered in the fixing device 25 is either stacked on a stacking unit 57 protrudingly provided from the left side panel in the diagram of the printer frame structure or is returned to the above-described secondary transfer nip for forming of a toner image on the reverse side.

The copying of an original document which is not shown in the diagram involves, for example, a bundle of original document sheets being set on an original document stand 30 of the original document auto-conveying device 400. If the original document is a bound document like a book the original document is set on a contact glass 32. Prior to this setting, the original document auto-conveying device 400 is opened from the copier main body and the contact glass 32 is exposed to light of the scanner 300. The closed original document auto-conveying device 400 then presses against the bound original document.

When a copy start switch not shown in the diagram is pushed following the setting of the original document in this way, an original document read operation by the scanner 300 starts. Incidentally, if original document sheets are set on the original document auto-conveying device 400, the original document auto-conveying device 400 automatically moves the original document sheets onto the contact glass 32 prior to the original document read operation being performed. The original document read operation involves first the start of scanning by both a first scanning body 33 and second scanning body 34 with light being emitted from a light source provided in the first scanning body 33. Reflected light from the surface of the original document is reflected by a mirror provided in the second scanning body 34 which, after passing through an imaging lens 35, alls incident on a read sensor 36. The read sensor 36 constructs image information in accordance with the incident light.

The drive of each of the devices of the process cartridges (18Y, M, C, K) of the intermediate transfer unit 17, the secondary transfer device 22 and the fixing device 25 is started in parallel with the original document read operation. The optical write unit 21 is drive-controlled in accordance with the image information constructed by the read sensor 36 to form Y, M, C, K toner images on each of the photosensitive bodies (40Y, M, C, K). These toner images are superposingly transferred onto the intermediate transfer belt 110 forming a 4-color toner image.

In addition, the paper feed operation of the paper feed device 200 is started essentially simultaneously with the start of the original document read operation. The paper feed operation involves selective rotation of one of the paper feed rollers 42 and transfer paper being fed out from one of the multiple-level paper feed cassettes 44 housed in a paper bank 43. The transfer paper having been fed out is separated into individual sheets by a separating roller 45 and moved into the paper feed path 46, after which it is conveyed by the conveyance roller pairs 47 toward the secondary transfer nip. Replacing paper feed from the paper feed cassette 44 performed in this way, paper feed from a manual insert tray 51 is also possible. In this case, a manual paper feed roller 50 is selectively rotated to feed out the transfer paper on the manual insert tray 51, after which a separating roller 52 separates the transfer paper into individual sheets and supplies it to a manual insert paper feed path 53 of the printer unit 100.

When images of other colors comprising at least two colors of toner are formed using this copier, the intermediate transfer belt 110 is tensioned in a state so that the upper part tensioned surface thereof is essentially horizontal so that all the photosensitive bodies (1Y, M, C, K) are brought into contact with the upper part tensioned surface. In contrast, when a monochrome image configured from a K toner alone is to be formed, the intermediate transfer belt 110 is set in a state by a mechanism not shown in the diagram to incline downward to the left in the diagram in such a way that the upper part tensioned surface is separated from the Y, M, C photosensitive bodies 1Y, M, C. The K toner image alone is imaged by rotation of only the K photosensitive body 1K of the four photosensitive bodies 1Y, M, C, K in the anti-clockwise direction in the diagram. To prevent unnecessary use of the photosensitive bodies and developer, the drive of not only the photosensitive bodies but also the development units for Y, M, C is stopped at this time.

The copier comprises a control unit not shown in the diagram configured from a CPU or the like that oversees the control of the elements of the copier noted below, and an operating display unit not shown in the diagram configured from a liquid crystal display and various key buttons and so on. An operator is able to select one of three single-side print modes for forming an image on a single side only of a transfer paper by sending a command to the control unit based on the implementation of a key input operation in the operation display unit. These three single side print modes are a direct discharge mode, a reflection discharge mode and a reflection decal discharge mode.

Figure 2:
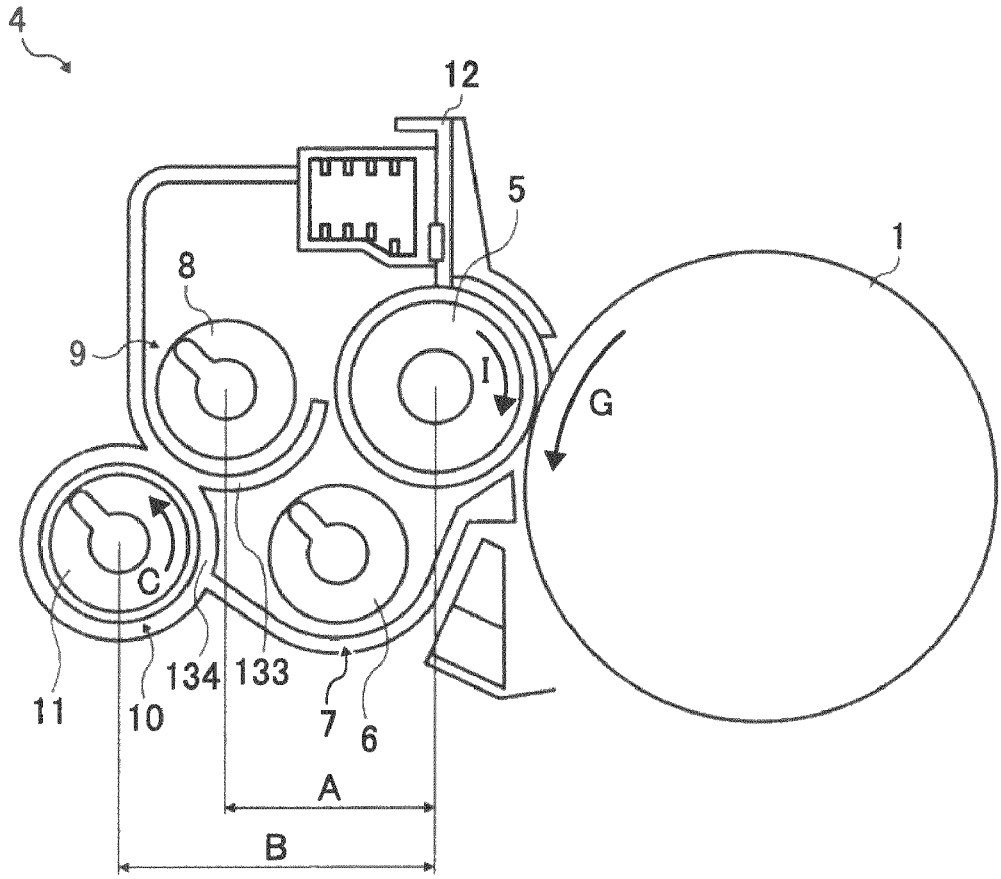
FIG. 2 is a diagram showing the schematic configuration of a development apparatus and a photosensitive body pertaining to this copier.

FIG. 2 shows the development apparatus 4 comprising one of the four process cartridges 18 (Y, M, C, K) and the photosensitive body 1. Apart from the fact that they handle respectively different colors, the configuration of each of the four process cartridges 18 (Y, M, C, K) is essentially identical and, accordingly, the annotations Y, M, C, K to the "4" of the diagram have been omitted.

The surface of the photosensitive body 1 is charged by a charging device not shown in the diagram as it rotates in the direction of the arrow G in the diagram shown in FIG. 2. Toner is supplied from the development apparatus 4 to a latent image formed as an electrostatic latent image on the surface of the charged photosensitive body 1 by a laser light irradiated from an exposure device not shown in the diagram to form a toner image.

The development apparatus 4 comprises a development roller 5 that serves as a developer carrier for supplying toner to develop the latent image on the surface of the photosensitive body 1 while surface moving in the direction of the arrow I of the diagram. The development roller 5 is configured from a magnet roller comprising a magnetic pole in its inner part, and a rotationally-driven sleeve member provided to cover the outer circumference of the magnet roller. In addition, it comprises a supply screw 8 serving as a developer supply conveyance member for, while supplying developer to the development roller 5, conveying developer in the direction toward the rear of FIG. 2. The developer supplied to the development roller 5 by the paper feed screw 8 is carried on the surface of the sleeve member as a result of the toner carrier being attracted by the magnetic force of the magnetic pole of the magnet roller.

A development doctor 12 serving as developer regulating member for regulating the developer supplied to the development roller 5 to a thickness suitable for development is provided on the downstream side in the direction of surface movement of the development roller 5 from an opposing part to the paper feed screw 8.

A recovery screw 6 serving as a developer recovery conveyance member for recovering developer used for development that has passed through the development unit and carrying the recovered recovery developer in the same direction as the paper feed screw 8 is provided on the downstream side in the direction of surface movement of the development roller 5 from the development unit which constitutes an opposing part to the photosensitive body 1. A supply conveyance path 9 serving as a developer supply conveyance path which comprises the paper feed screw 8 is arranged in the lateral direction of the development roller 5, and a recovery conveyance path 7 serving as a developer recovery conveyance path which comprises the recovery screw 6 is arranged in parallel below the development roller 5.

A part of the magnet roller not comprising a magnetic pole is provided between the position where the development roller 5 opposes the recovery conveyance path 7 and the position where the development roller 5 opposes the supply conveyance path 9. As a result, the developer from which the toner carried by the sleeve member has been consumed can be separated and isolated so as to be recovered in the recovery conveyance path 7.

The clearance in the development apparatus 4 between the surface of the development doctor 12 and the development roller 5 forms a development doctor as a slit-shaped opening between the development region in which the photosensitive body 1 and development roller 5 are opposing and the supply conveyance path 9. By forming of a slit-shaped opening, that is to say, by forming of a narrow clearance, scattering of the developer in the development region of the development apparatus 4 from the upstream side in the direction of surface movement of the development roller 5 can be suppressed. In addition, the development apparatus 4 comprises a part in which the clearance between a casing forming the recovery conveyance path 7 and the surface of the development roller 5 forms a slit-shaped opening between the development region in which the photosensitive body 1 and development roller 5 are opposing and the recovery conveyance path 7. By forming of a slit-shaped opening, that is to say, by forming of a narrow clearance, the scattering of the developer in the development region of the development apparatus 4 from the downstream side in the direction of surface movement of the development roller 5 can be suppressed.

An agitation conveyance path 10 serving as a developer agitation conveyance path is provided in the development apparatus 4 in parallel with the recovery conveyance path 7 below the supply conveyance path 9. The agitation conveyance path 10 comprises an agitation screw 11 serving as a developer agitation conveyance member for, while agitating the developer, conveying it in the opposite direction to the paper feed screw 8 which is toward the front side in the diagram.

The supply conveyance path 9 and agitation conveyance path 10 are partitioned by a first partition wall 133 serving as a partition member. An opening is formed in part of the first partition wall 133 that partitions the supply conveyance path 9 and agitation conveyance path 10 at both ends in the front side and back side of the diagram to link the supply conveyance path 9 and agitation conveyance path 10.

While the supply conveyance path 9 and recovery conveyance path 7 are also partitioned by the first partition wall 133, there is no opening provided in the part where the first partition wall 133 partitions the supply conveyance path 9 and recovery conveyance path 7.

The two conveyance paths between the agitation conveyance path 10 and recovery conveyance path 7 are also partitioned by a second partition member 134 serving as a partition member. An opening is formed in the second partition member 134 at the front side in the diagram to link the agitation conveyance path 10 and recovery conveyance path 7.

Each of the paper feed screw 8, recovery screw 6 and agitation screw 11 that serve as developer conveyance members are configured from a resin and have a screw diameter of ϕ18 [mm], screw pitch 25 [mm], and a number of revolutions set to 600 [rpm].

The developer formed in a thin layer on the development roller 5 by the development doctor 12 configured from stainless steel is conveyed for development to the development region that constitutes a corresponding part to the photosensitive body 1. The surface of the development roller 5 is configured from an ϕ25 [mm] Al [aluminum] base pipe that is either V-groove or sandblast-processed, the gap thereof with the development doctor 12 and photosensitive body 1 being of the order of 0.3 [mm]. The development doctor 12, which is usually configured from a stainless steel panel or the like, is set a distance of the order of 0.2 to 1.2 [mm] away from the surface of the development roller and affords the formation of a uniform thin layer of developer on the development roller 5 and supply of a uniform developer free of irregularities to the electrostatic latent image on the photosensitive body 1.

The developer used for development is recovered in the recovery conveyance path 7 and conveyed to the front side in the cross-section of FIG. 2 and, through the opening of the first partition wall 133 provided in the non-imaging region part, is conveyed to the agitation conveyance path 10. Toner is supplied to the agitation conveyance path 10 through a toner replenishment port provided on the upstream side of the agitation conveyance path 10 in proximity of the opening of the first partition wall 133 on the upstream side in the direction of conveyance of the developer in the agitation conveyance path 10.

The circulation of the developer in the three developer conveyance paths will be hereinafter described.

Figure 3:
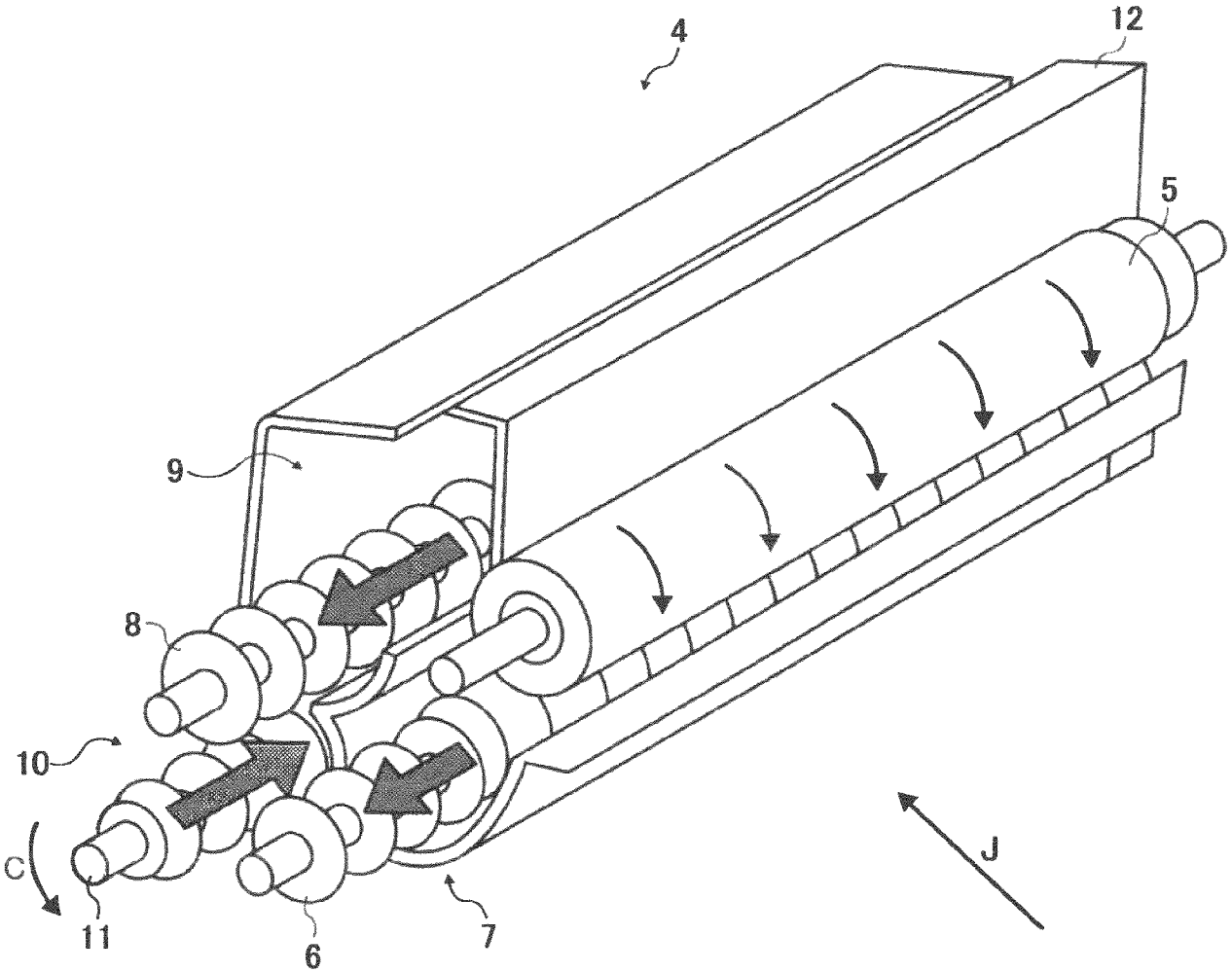
FIG. 3 is a perspective cross-sectional view of the development apparatus for explaining the flow of a developer.

FIG. 3 is a perspective cross-sectional view of the development apparatus 4 for explaining the flow of the developer in the developer conveyance paths. The arrows in the diagram indicate the direction of movement of the developer.

Figure 4:
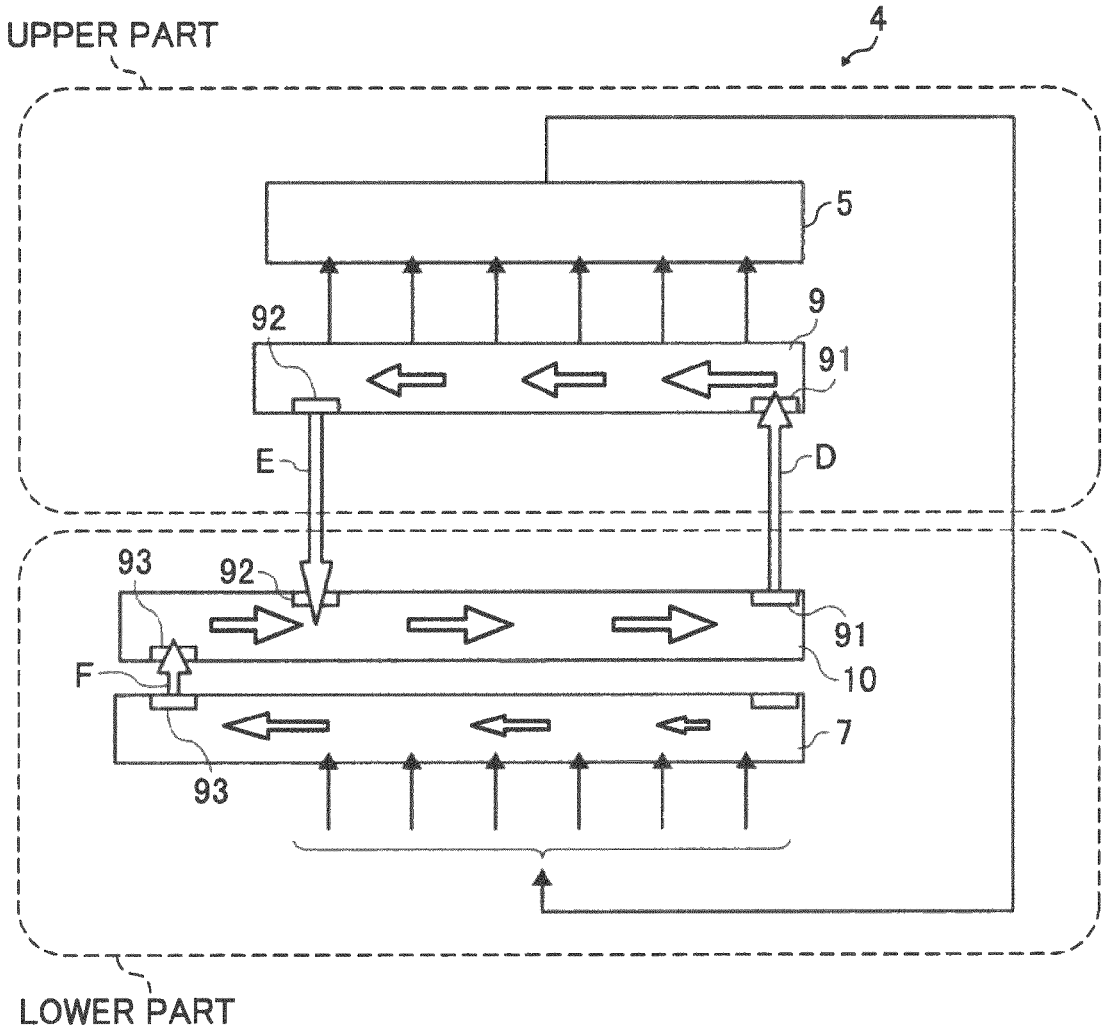
FIG. 4 is a type diagram showing the flow of the developer in this development apparatus.

In addition, FIG. 4 is a type diagram of the flow of the developer in the development apparatus 4 in which, similarly to FIG. 3, the arrows in the diagram indicate the direction of movement of the developer.

In the supply conveyance path 9 to which developer is supplied from the agitation conveyance path 10, developer is conveyed to the downstream side in the direction of conveyance of the supply screw 8 while developer is being supplied to the development roller 5. Surplus developer that has been supplied to the development roller 5 but, without having been employed for development, has been conveyed to the downstream end in the direction of conveyance of the supply conveyance path 9 is supplied to the agitation conveyance path 10 through a surplus opening 92 of the first partition wall 133 (see arrow E of FIG. 4).

The recovery developer fed from the development roller 5 to the recovery conveyance path 7 and conveyed to the downstream end in the direction of conveyance of the recovery conveyance path 7 by the recovery screw 6 is supplied to the agitation conveyance path 10 through a recovery opening 93 of the second partition member 134 (see arrow F of FIG. 4).

The agitation conveyance path 10 agitates the supplied surplus developer and recovery developer, conveys it to the upstream side in the direction of conveyance of the supply screw 8 which constitutes the downstream side in the direction of conveyance of the agitation screw 11, and supplies it to the supply conveyance path 9 through a supply opening 91 of the first partition wall 133 (see arrow D of FIG. 4).

In the agitation conveyance path 10, recovery developer, surplus developer and toner replenished in accordance with need by means of a transport unit are conveyed while being agitated by the agitation screw 11 in the reverse direction to the developer of the recovery conveyance path 7 and supply conveyance path 9. The agitated developer is transported to the upstream side in the direction of conveyance of the supply conveyance path 9 that is linked at the downstream side in the direction of conveyance. A toner density sensor not shown in the diagram is provided below the agitation conveyance path 10, a toner replenishment control device not shown in the diagram being actuated by the output of the sensor so that toner is replenished from a toner housing part not shown in the diagram.

In the development apparatus 4 shown in FIG. 4 comprising a supply conveyance path 9 and recovery conveyance path 7, because the supply and recovery of the developer is implemented in different developer conveyance paths, an intermixing with the developer used for development in the supply conveyance path 9 is prevented. Accordingly, a drop in the toner density of the developer supplied to the development roller 5 toward the downstream side in the direction of conveyance of the supply conveyance path 9 can be prevented. In addition, because the apparatus comprises a recovery conveyance path 7 and agitation conveyance path 10 and recovery and agitation of the developer are implemented in different developer conveyance paths, loss of the developer used in development while it is being agitated is prevented. Accordingly, because the developer supplied to the supply conveyance path 9 has been thoroughly agitated, insufficient agitation of the developer supplied to the supply conveyance path 9 can be prevented. Because a drop in toner density of the developer of the supply conveyance path 9 and insufficient agitation of the developer in the supply conveyance path 9 can be prevented in this way, a constant image density can be ensured throughout development.

As shown in FIG. 4, the movement of the developer is from the lower part to the upper part of the development apparatus 4 alone as indicated by the arrow D. The movement of the developer indicated by the arrow D consists of the developer being made to rise as a result of a pressing of the developer created by the rotation of the agitation screw 11 which causes the developer to be supplied to the supply conveyance path 9.

The movement of the developer in this way imparts stress on the developer and is one factor in a shortening of the lifespan of the developer.

The developer is subject to stress when it is lifted upward from below in this way and scraping of the carrier film and spent toner is created in the developer at these points of stress whereupon, to that end, stability of image quality is unable to be maintained.

Accordingly, by alleviating the stress on the developer that occurs when the developer is moved in the manner indicated by the arrow D, an increase in the lifespan of the developer can be achieved. By achieving increased lifespan of the developer, deterioration of the developer can be prevented and a development apparatus that produces constant stable image quality free of image density irregularities can be provided.

As shown in FIG. 2, in this embodiment of the development apparatus 4 the supply conveyance path 9 is arranged diagonally above the agitation conveyance path 10. The stress on the developer can be relieved by this arrangement compared with when the developer is lifted up in an arrangement in which the supply conveyance path 9 is provided vertically above the agitation conveyance path 10 and the developer is moved as indicated by the arrow D.

Furthermore, as shown in FIG. 2, the upper wall surface of the agitation conveyance path 10 is arranged in a higher position than the lower wall surface of the supply conveyance path 9 as a result of the diagonal arrangement of the supply conveyance path 9 and agitation conveyance path 10 in the development apparatus 4.

The lifting of the developer of the supply conveyance path 9 vertically upward with respect to the agitation conveyance path 10 places stress on the developer because the developer is lifted by the pressure of the agitation screw 11 in opposition to the gravitational force. On the other hand, because the developer at the highest point of the agitation conveyance path 10 can flow to the lowermost point of the supply conveyance path 9 without opposition to gravitational force as a result of the arrangement of the upper wall surface of the agitation conveyance path 10 in a higher position than the lower wall surface of the supply conveyance path 9, the stress acting on the developer can be lessened.

A fin member may be provided in the axis of the agitation screw 11 in the section where the agitation conveyance path 10 and supply conveyance path 9 are linked on the downstream side in the developer conveyance path of the agitation conveyance path 10. The fin member constitutes a flat-shaped member comprising a side parallel to the axial direction of the agitation screw 11, and a side perpendicular to the axial direction of the agitation screw. The delivery of the developer from the agitation conveyance path 10 to the supply conveyance path 9 can be more efficiently performed as a result of a combing up of the developer performed by this fin member.

In addition, the supply conveyance path 9 and agitation conveyance path 10 are arranged in the development apparatus 4 in such a way that a distance A between the middle of the development roller 5 and the supply conveyance path 9 is shorter than a distance B between the middle of the development roller 5 and the agitation conveyance path 10. As a result, the developer can be easily supplied from the supply conveyance path 9 to the development roller 5, and a reduction in size of the apparatus can be achieved.

In addition, the agitation screw 11 is rotated in the anticlockwise direction (direction of the arrow C in the diagram) as seen from the front side of FIG. 2, whereupon the developer is lifted up along the shape of the agitation screw 11 and transported to the supply conveyance path 9. As a result, the developer can be efficiently lifted up and a further lessening of the stress on the developer can be achieved.

The characterizing elements of the development apparatus 4 will be hereinafter described.

Figure 5:
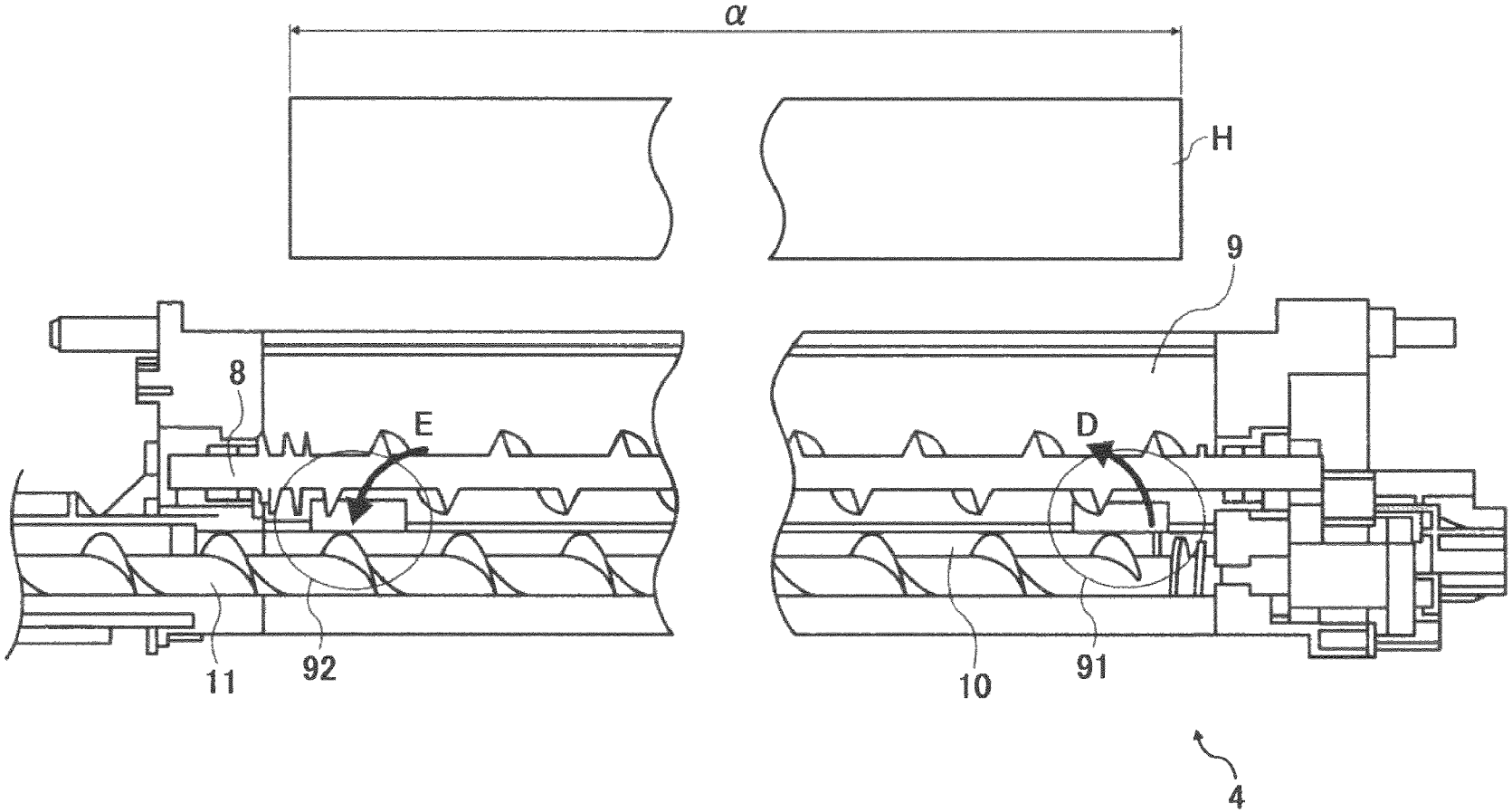
FIG. 5 is a cross-sectional view of the configuration of this development apparatus.

FIG. 5 is a cross-sectional explanatory diagram as seen from the direction of the arrow J of FIG. 3 of a cross-section of the revolving center of the supply screw 8 of the development apparatus 4. The symbol H in the diagram denotes the development region in which the development roller 5 serving as the developer carrier supplies toner to the photosensitive body 1 that serves as the latent image carrier. The width in the axial direction of the rotating axis of the development roller 5 of the development region H is referred to as the development region width $\alpha$.

As shown in FIG. 5, both the supply opening 91 which constitutes the position where the developer is lifted up from the agitation conveyance path 10 to the supply conveyance path 9 and the surplus opening 92 where the developer is caused to fall from the supply conveyance path 9 to the agitation conveyance path 10 are provided in the development region width $\alpha$ of the development apparatus 4.

Figure 6:
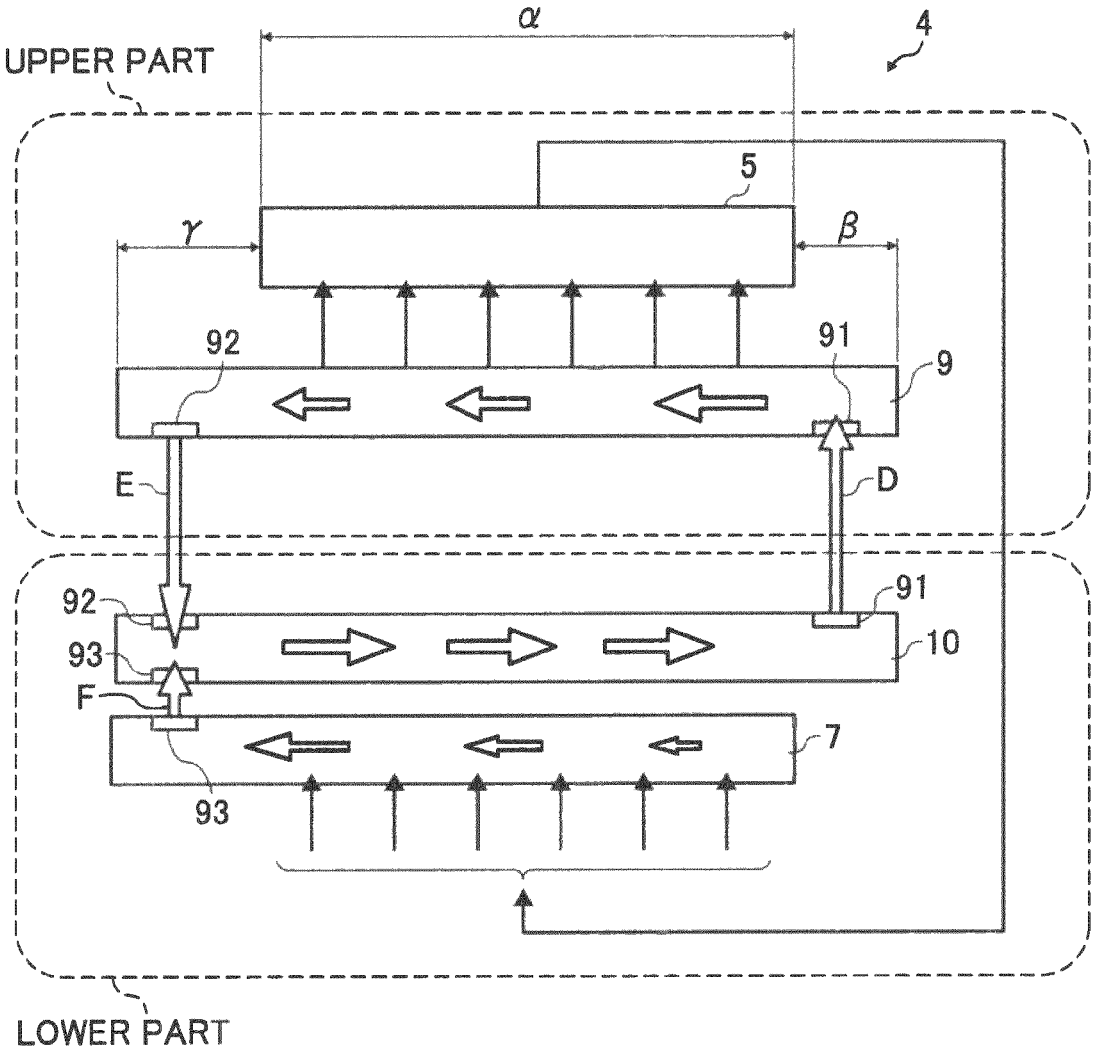
FIG. 6 PRIOR ART
FIG. 6 is a type diagram showing the flow of a developer in a conventional development apparatus.

FIG. 6 shows the flow of developer in a conventional development apparatus 4.

In a conventional development apparatus 4, the supply opening 91 and surplus opening 92 are provided on the outer side of the development region width $\alpha$ as shown in FIG. 6. Because the supply opening 91 is provided on the outer side of the development region width $\alpha$, the upstream side in the direction of conveyance of the supply conveyance path 9 is longer than the development roller 5 by the size of a supply conveyance path upstream side region $\beta$. In addition, because the surplus opening 92 is provided on the outer side of the development region width $\alpha$, the downstream side in the direction of conveyance of the supply conveyance path 9 is longer than the development roller 5 by the size of a supply conveyance path downstream side region $\gamma$.

On the other hand, in the development apparatus 4 of this embodiment as shown in FIG. 4, because the supply opening 91 is provided in the development region width $\alpha$, the upstream side in the direction of conveyance of the supply conveyance path 9 can be made shorter than the conventional development apparatus 4 by the size of the supply conveyance path upstream side region $\beta$. In addition, because the surplus opening 92 is provided in the development region width $\alpha$, the downstream side in the direction of conveyance of the supply conveyance path 9 can be made shorter than the conventional development apparatus 4 by the size of the supply conveyance path downstream side region $\gamma$.

Because the supply opening 91 and surplus opening 92 are provided in the development region width $\alpha$ in the development apparatus 4 of this embodiment in this way, a space saving of the upper part of the development apparatus 4 compared to the conventional development apparatus 4 can be achieved.

Figure 7:
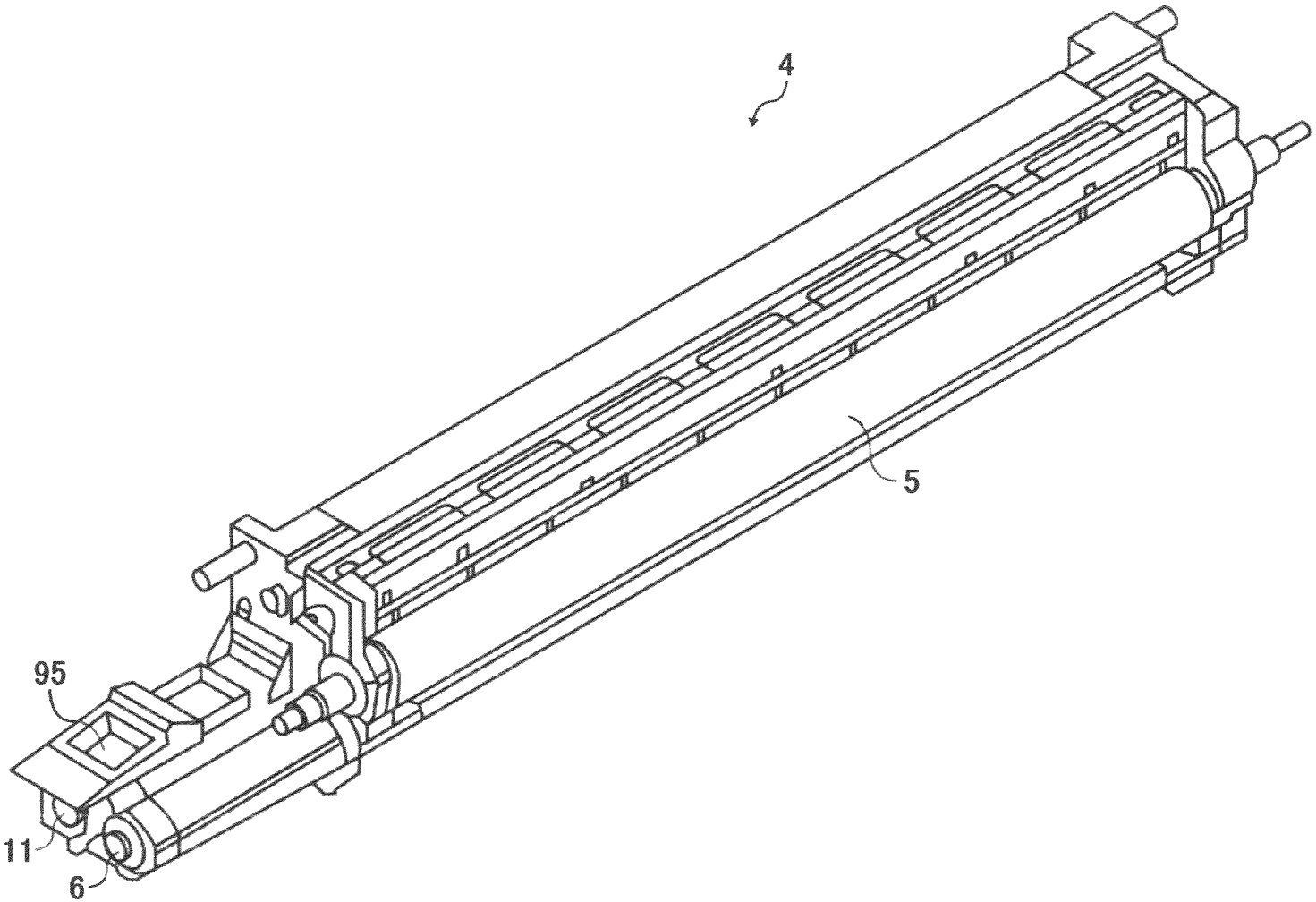
FIG. 7 is an exterior perspective view of the configuration of this development apparatus.

The positions where the toner is replenished to the developer conveyance paths of the supply conveyance path 9, agitation carry path 10 and recovery conveyance path 7 of the development apparatus 4 will be hereinafter described. FIG. 7 shows an exterior view of the development apparatus 4.

As shown in FIG. 7, a toner replenishment port 95 for replenishment of toner is provided above the end part on the upstream side in the direction of conveyance of the agitation conveyance path 10 comprising the agitation screw 11. The toner replenishment port 95 is provided on the outer side of the end part in the width direction of the development roller 5 and, accordingly, is on the outer side of the development region width $\alpha$.

The toner replenishment port 95 is provided in a position along an extension in the direction of conveyance of the supply conveyance path 9 corresponding to a free space of the supply conveyance path downstream side region $\gamma$ of FIG. 6. By provision of the toner replenishment port 95 in the free space afforded by provision of the surplus opening 92 in the development region width α, a reduction in size of the development apparatus 4 can be achieved.

In addition, the provision of the toner replenishment port 95 is not restricted to the position above the end part on the upstream side in the direction of conveyance of the agitation conveyance path 10 and may be provided in a position above the end part on the downstream side of the recovery conveyance path 7.

Furthermore, the toner replenishment port 95 may be provided directly above the recovery opening 93 that serves as the position where the developer is delivered from the recovery conveyance path 7 to the agitation conveyance path 10. Because the space directly above the recovery opening 93 also constitutes a free space afforded by the provision of the surplus opening 92 in the development region width α, a reduction in size of the development apparatus 4 can be achieved by provision of the toner replenishment port 95 in this position. Furthermore, because the developer is mixed at the recovery opening 93 that serves as a delivery part, a more efficient agitation of the developer can be achieved by replenishment performed at this position.

MODIFIED EXAMPLE 1

A space saving of the upper part of the development apparatus 4 can be achieved in this embodiment compared with the conventional development apparatus 4 by provision of the supply opening 91 and the surplus opening 92 in the development region width α. Thereupon, even in a configuration in which the surplus opening 92 only is provided in the development region width α, a space saving of the development apparatus 4 can be achieved compared with the conventional development apparatus 4. As a modified example 1 thereof, a configuration in which the surplus opening 92 is provided in the development region will be hereinafter explained.

Figure 8:
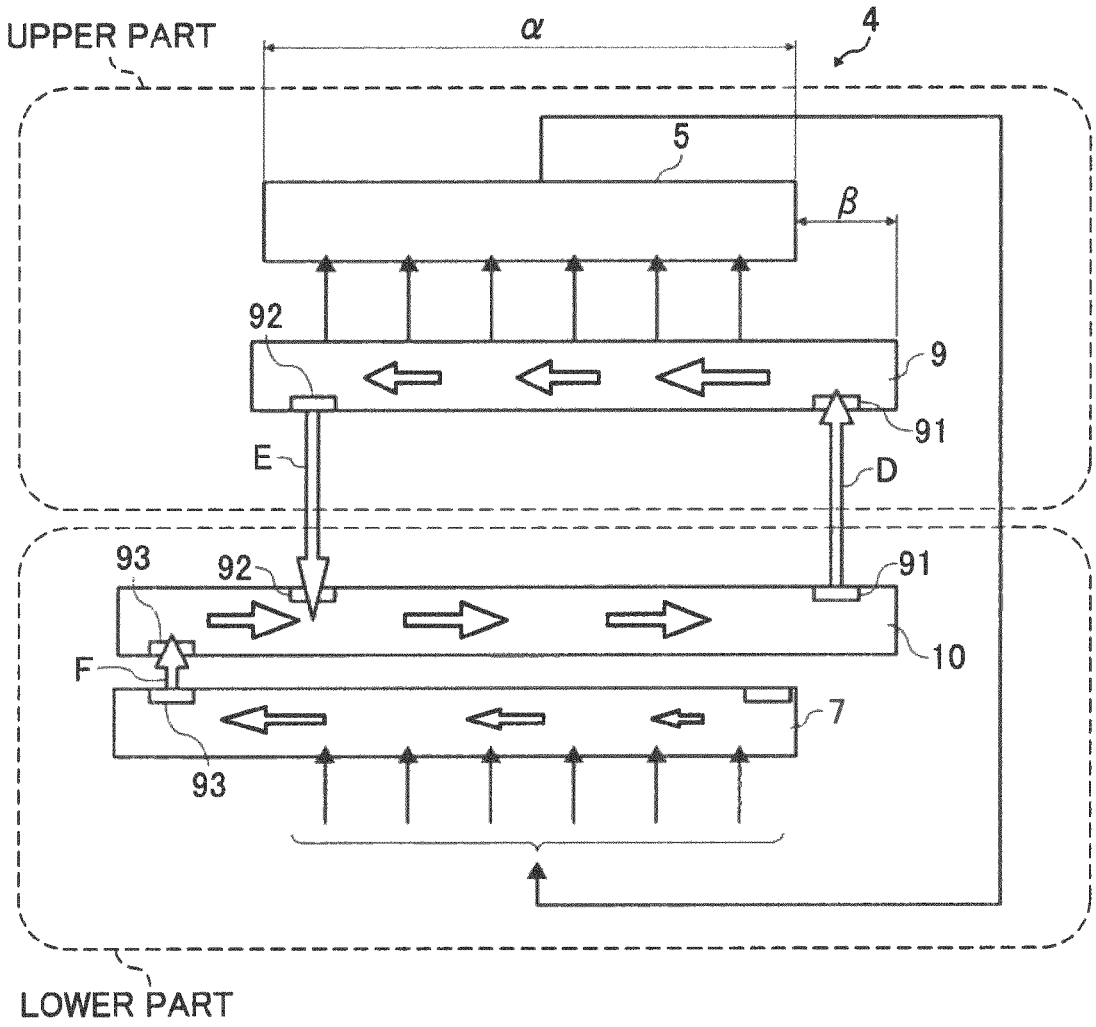
FIG. 8 is a type diagram showing the flow of a developer in a development apparatus pertaining to a modified example 1 of the embodiment.

FIG. 8 shows the flow of the developer in the development apparatus 4 pertaining to modified example 1.

As shown in FIG. 8, because the surplus opening 92 is provided in the development region width α, the downstream side in the direction of conveyance of the supply conveyance path 9 be made shorter than the conventional development apparatus 4 shown in FIG. 6 by the size of the supply conveyance path downstream side region γ.

Because the surplus opening 92 can be provided in the development region width α in the development apparatus 4 of modified example 1 in this way, a space saving of the upper part of the development apparatus 4 can be achieved compared with a conventional development apparatus 4.

MODIFIED EXAMPLE 2

A space saving of the upper part of the development apparatus 4 is achieved in this embodiment compared with the conventional development apparatus 4 by provision of the supply opening 91 and the surplus opening 92 in the development region width α. Thereupon, even in a configuration in which the supply opening 91 only is provided in the development region width α, a space saving of the development apparatus 4 can be achieved compared with the conventional development apparatus 4. As a modified example 2 thereof, a configuration in which the supply opening 91 is provided in the development region will be hereinafter explained.

Figure 9:
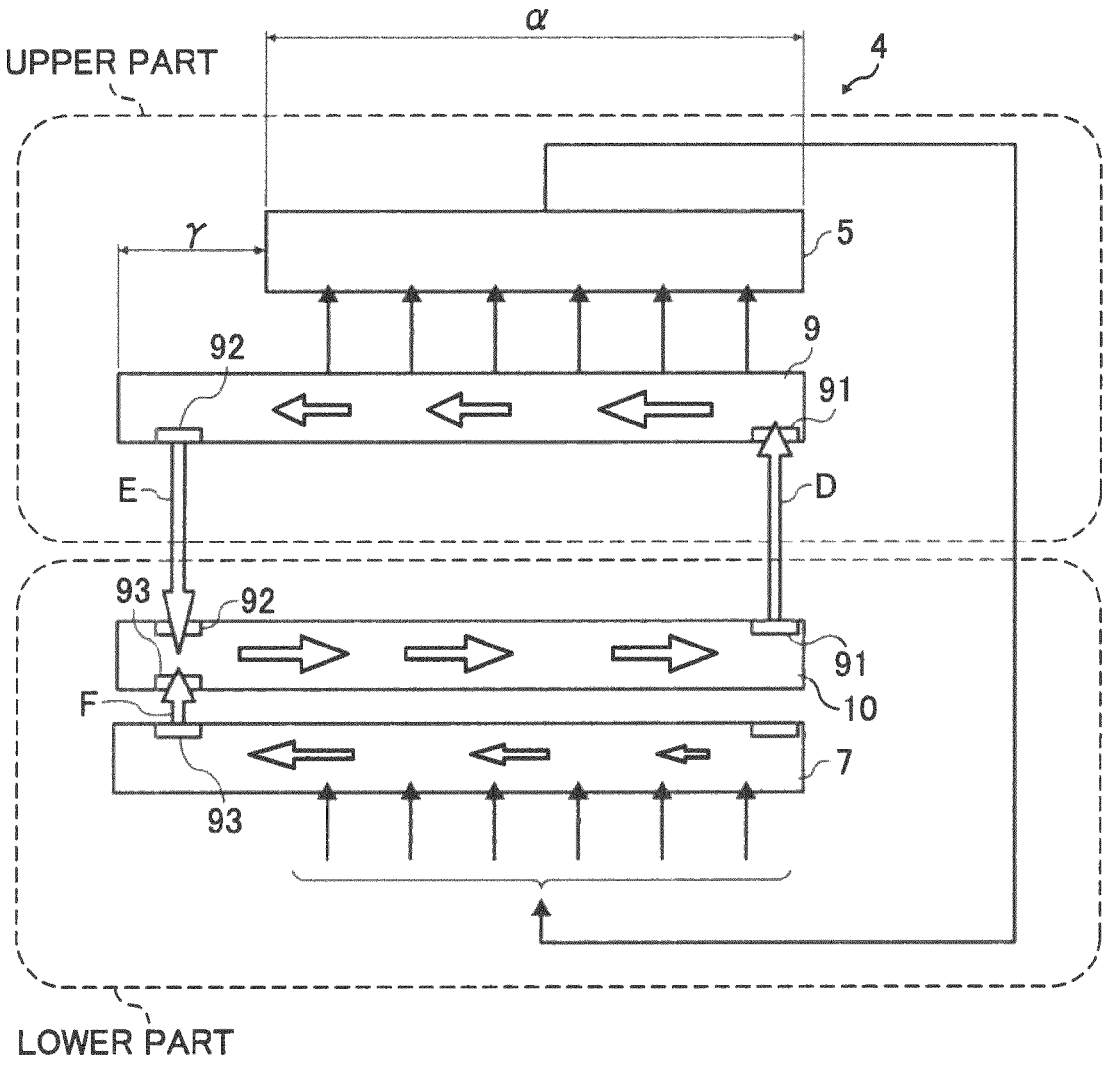
FIG. 9 is a type diagram showing the flow of a developer in the development apparatus pertaining to a modified example 2 thereof.

FIG. 9 shows the flow of the developer in the development apparatus 4 pertaining to modified example 2.

As shown in FIG. 9, because the supply opening 91 is provided in the development region width α, the downstream side in the direction of conveyance of the supply conveyance path 9 be made shorter than the conventional development apparatus 4 by the size of the supply conveyance path upstream side region β.

Because the supply opening 91 can be provided in the development region width α in the development apparatus 4 of modified example 2, a space saving of the upper part of the development apparatus 4 can be achieved compared with a conventional development apparatus 4.

MODIFIED EXAMPLE 3

A space saving of the upper part of the development apparatus 4 is achieved in this embodiment compared with the conventional development apparatus 4 by provision of the supply opening 91 and the surplus opening 92 in the development region width α. Thereupon by providing, in the development region width α, a recovery opening 93 serving as an opening of a partition member on the downstream side in the direction of conveyance of the developer recovery conveyance path with the developer agitation conveyance path, the recovery opening constituting the location at which the developer recovered from the recovery conveyance path 7 is delivered to the agitation conveyance path 10, a further space saving of the development apparatus 4 can be achieved. As a modified example 3 thereof, a configuration in which the recovery opening 93 is provided in the development region width α will be hereinafter explained. Other than the positional arrangement of the recovery opening 93 and toner replenishment port 95 the configuration thereof is common to the development apparatus 4 of the embodiment and, accordingly, only the points of difference will be explained.

Figure 10:
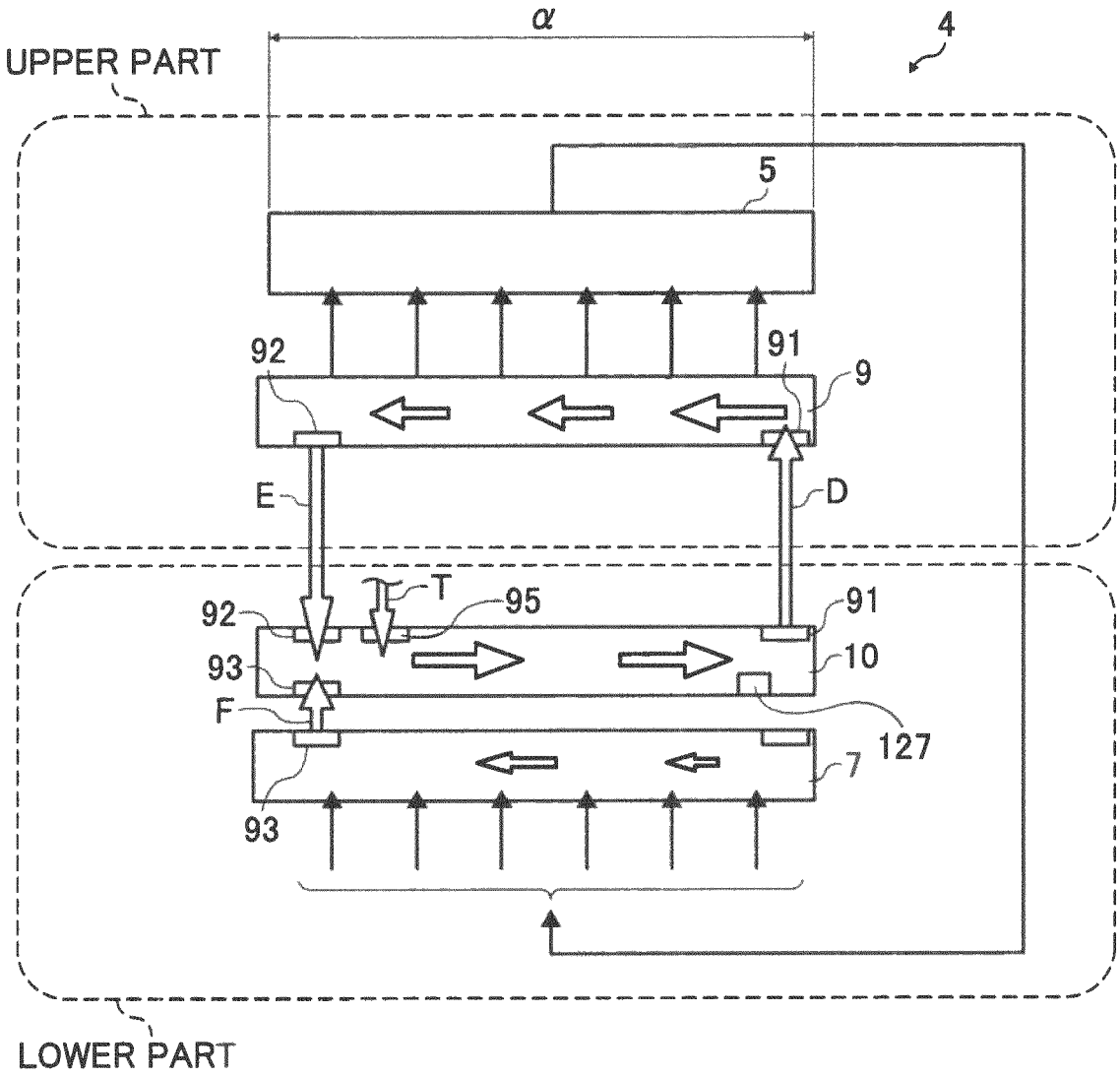
FIG. 10 is a type diagram showing the flow of a developer in the development apparatus pertaining to a modified example 3 thereof.

FIG. 10 shows the flow of developer in the development apparatus 4 pertaining to modified example 3.

In the development apparatus 4 of modified example 3 as shown in FIG. 10, because the supply opening 91 is provided in the development region width α, the upstream side in the direction of conveyance of the supply conveyance path 9 can be made shorter than the conventional development apparatus 4 shown in FIG. 6 by the size of the supply conveyance path upstream side region β. In addition, because the surplus opening 92 is provided in the development region width α, the downstream side in the direction of conveyance of the supply conveyance path 9 can be made shorter than the conventional development apparatus 4 shown in FIG. 6 by the size of the supply conveyance path downstream side region γ.

Because the supply opening 91 and surplus opening 92 are provided in the development region width α of the development apparatus 4 of modified example 3 in this way, a space saving of the upper part of the development apparatus 4 can be achieved compared with the conventional development apparatus 4 shown in FIG. 6.

In addition, as shown in FIG. 10, because the recovery opening 93 is provided in the development region width α of the development apparatus 4 of modified example 3 in this way, the downstream side in the direction of conveyance of the recovery conveyance path 7 can be made shorter than the conventional development apparatus 4 shown in FIG. 6 and the development apparatus 4 of the embodiment shown in FIG. 4.

By provision in the development apparatus 4 of modified example 3 of the recovery opening 93 in the development region width α and shortening of the length of the recovery conveyance path 7 in this way, a space saving of the lower part of the development apparatus 4 can be achieved compared to the conventional development apparatus 4 shown in FIG. 6 and the development apparatus 4 of the embodiment shown in FIG. 4.

In addition, because the development region width α lies on the inner side in the width of the axial direction of the development roller 5 which constitutes the developer carrier, the recovery opening 93 can exist in the inner side of the width in the axial direction of the development roller 5.

Because the development apparatus 4 of modified example 3 comprises a supply conveyance path 9, recovery conveyance path 7 and agitation conveyance path 10 that serve as developer conveyance paths with separate functions for the supply, recovery and agitation of the developer, the problem of irregularities in image density or drop in image density occurring in the development apparatus where the developer supplied to the development roller is recovered by the supply conveyance path or agitation conveyance path can be prevented. Furthermore, the recovery opening 93 is provided in the development region width α, and the recovery screw 6 which constitutes a developer recovery conveyance member is set to a length in the direction parallel to the axial direction of the development roller 5 that does not exceed the length of the development roller 5. By making the recovery screw 6 shorter than the development roller 5, the length in the direction of conveyance of the recovery conveyance path 7 can be shortened.

In the development apparatus 4 of modified example 3, because the supply opening 91 and surplus opening 92 are provided in the development region width α and the recovery opening 93 is also provided in the development region width α, the downstream side and upstream side in the direction of conveyance of the agitation conveyance path 10 can be made shorter than in the conventional development apparatus 4 shown in FIG. 6. In addition, in the development apparatus 4 of modified example 3, the supply opening 91, surplus opening 92 and recovery opening 93 are provided in the development region width α, and the agitation screw 11 which constitutes the developer agitation conveyance member is set to a length in the direction parallel to the axial direction of the development roller 5 that does not exceed the length of the development roller 5. By making the agitation screw 11 shorter than the development roller 5, the length in the direction of conveyance of the agitation conveyance path 10 can be shortened.

In the embodiments described above, the toner replenishment port 95 is provided on the outer side of the width of the development roller 5 in the axial direction as shown in FIG. 7. When the toner replenishment port 95 is provided on the outer side of the width of the development roller 5 in the axial direction in this way, even if the supply opening 91, surplus opening 92 and recovery opening 93 are provided within the development region width α, at least the developer conveyance path comprising the toner replenishment port 95 of the recovery conveyance path 7, supply conveyance path 9 and agitation conveyance path 10 needs to be longer than the development roller 5 by the size of the toner replenishment port 95.

On the other hand, in the modified example 3 of development apparatus 4, the toner replenishment port 95 for replenishing toner to the developer conveyance paths which include the recovery conveyance path 7, the supply conveyance path 9 and the agitation conveyance path 10 is provided in the development region width α.

Figure 11:
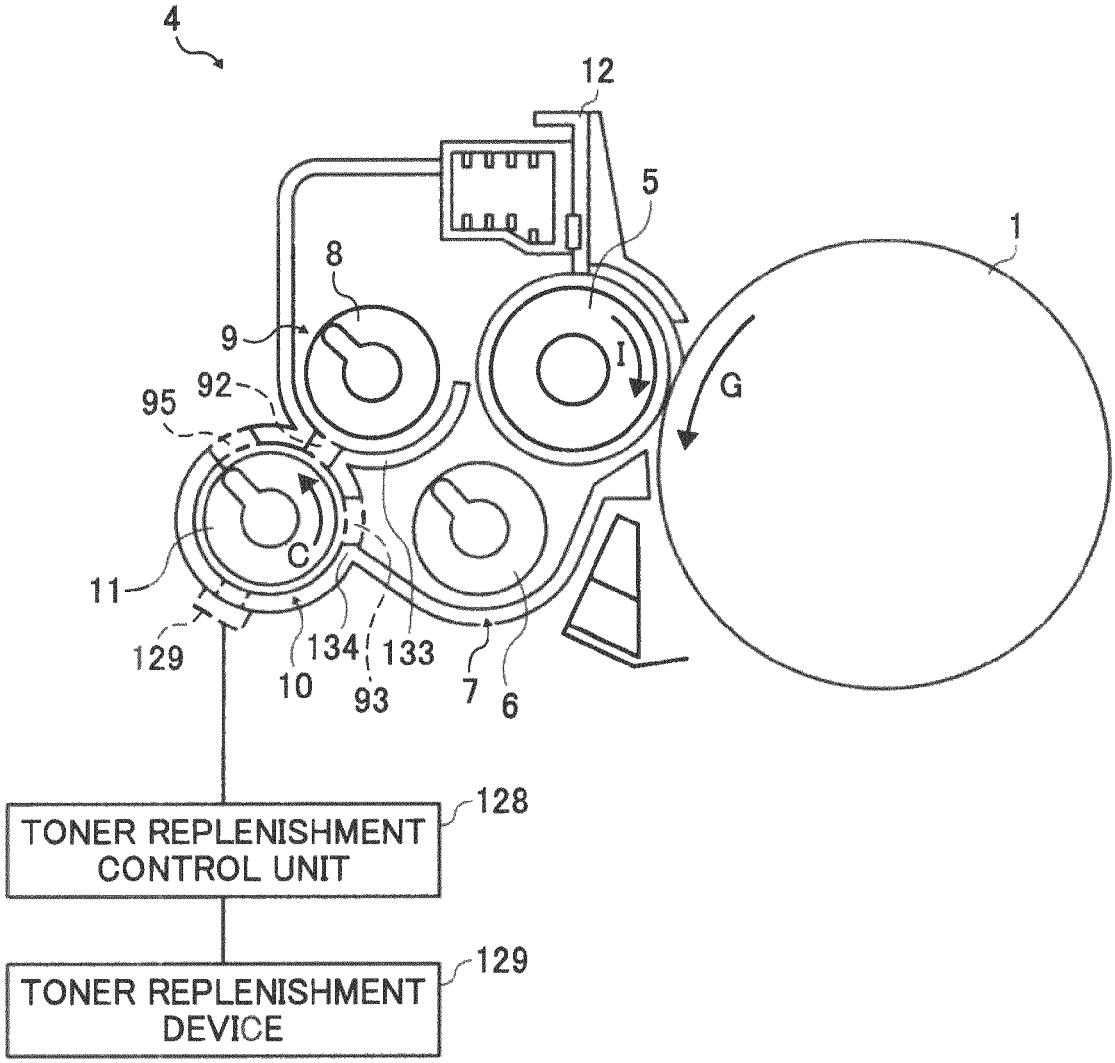
FIG. 11 is a diagram showing the schematic configuration of the development apparatus and a photosensitive body pertaining to the modified example 3 thereof.

FIG. 11 is a cross-sectional explanatory diagram of the parts where the supply opening 91, surplus opening 92 and recovery opening 93 of the development apparatus 4 pertaining to modified example 3 are provided. In the development apparatus 4 of modified example 3 shown in FIG. 11, the toner replenishment port 95 is provided in an identical position to the parts where the supply opening 91, surplus opening 92 and recovery opening 93 are provided in the axial direction of the development roller 5. While FIG. 10 shows the toner replenishment port 95 as being provided on the inner side of the surplus opening 92, in the development apparatus 4 of modified example 3, the toner replenishment port 95 is provided in an identical position to the parts where the supply opening 91, surplus opening 92 and recovery opening 93 are provided.

As shown in FIG. 11, a toner density sensor 127 is provided below the agitation conveyance path 10, a toner supply control unit 128 controlling the operation of an toner replenishment device 129 based on output of the sensor resulting in replenishment of toner from a later-described toner housing unit not shown in the diagram by way of the toner replenishment port 95. In the process for replenishing new toner to the developer that has been used for development of this configuration, the toner density of the developer to which new toner has been supplied and mixed therewith is measured by the toner density sensor 127 and, by the operation of the toner replenishment device 129 which is controlled by the toner supply control unit 128, the appropriate quantity of toner is replenished to the development apparatus 4 through the toner replenishment port 95. The configuration of FIG. 10 and FIG. 11 comprises a toner replenishment port 95 to which new toner is supplied provided on the upstream side in the direction of conveyance of the agitation screw 11 of the agitation conveyance path 10. The toner density sensor 127 for measuring the toner density and emitting a signal for feedback to the toner supply control unit 128 is arranged downstream in the direction of conveyance of the agitation screw 11.

The toner density sensor 127 for detecting the toner density of the development apparatus 4 shown in FIG. 10 and FIG. 11 detects the toner density of the developer subsequent to the mixing of the new toner therewith. The toner density sensor 127 may be provided in an arrangement for detecting the toner density of the developer from which toner has been consumed and replenishing the consumed toner amount as appropriate. More specifically, the toner density sensor 127 may be arranged and set on the downstream side in the direction of conveyance of the recovery screw 6 of the recovery conveyance path 7. In this way, an arrangement of the toner density sensor 127 within the imaging region (development region) for detecting the state prior to the toner being mixed in the developer or detecting the state following the mixing of the toner is possible.

As shown in FIG. 10 and FIG. 11, by provision of the toner replenishment port 95 through which toner from the toner replenishment device 129 is replenished to the development apparatus 4 as shown by the arrow T in a part that constitutes the development region width α of the supply conveyance path 9, the need for the supply conveyance path 9 comprising the toner replenishment port 95 to be set longer than the development roller 5 by the size of the toner replenishment port 95 is eliminated. As a result, the supply conveyance path 9 can be shortened by the size of the toner replenishment port 95 and, compared with the development apparatus 4 explained in the embodiment shown in FIG. 4, a space saving of the lower part of the development apparatus 4 can be achieved.

The configuration based on the provision of the toner replenishment port 95 within the development region width α is not restricted to a configuration in which the toner replenishment port 95 is provided in a position identical to the location in which the supply opening 91, surplus opening 92 and recovery opening 93 are provided and, as shown in FIG.

10, the toner replenishment port 95 may be provided in the inner side from the part where the surplus opening 92 is provided.

In addition, in modified example 3, the toner density sensor 127 for detecting the toner density is provided in the agitation conveyance path 10 on the downstream side in the direction of conveyance of the developer of the agitation screw 11 from the toner replenishment port 95. As a result, the arrangement of toner replenishment port 95 which serves as the opening for toner replenishment and, in addition, the toner density sensor 127, can be set within the inner side of the width of the development roller 5 in the axial direction and, as a result, all openings provided in the developer 4 are provided in the inner side of the development region width α and a reduction in size of the development apparatus 4 can be realized.

In a specific explanation of the preferred constitution and operation of a development apparatus comprising three developer conveyance paths with separate functions and three conveyance screws, the supply screw 8 and recovery screw 6 are provided in parallel to the development roller 5 and a state in which the supply screw 8 and recovery screw 6 convey the developer in the same direction with respect to the axial direction of the development roller 5 is established. On the other hand, the agitation screw 11 is configured to convey the developer in a different direction to that of the supply screw 8 and recovery screw 6.

In addition, the developer must be delivered through the supply opening 91 to the supply conveyance path 9 that comprises the supply screw 8 whiles the developer is accumulating on the agitation conveyance path 10 in the furthermost downstream side in the direction of conveyance of the agitation screw 11. Thereupon, in order to as far as possible prevent loss of the developer occurring while it is being conveyed in the agitation conveyance path 10, the space between the inner wall of the agitation conveyance path 10 of the casing from which the development apparatus 4 is configured and the agitation screw 11 should be made as small as possible. That is to say, the casing that forms the agitation conveyance path 10 is preferably formed in a shape that, following the outer circumference of a propeller part of the agitation screw 11, surrounds the agitation screw 11. Using an agitation conveyance path 10 of this shape, the developer accumulated on the downstream side in the direction of conveyance of the agitation screw 11 in the agitation conveyance path 10 is able to be efficiently conveyed to the supply conveyance path 9 through the supply opening 91.

The configuration based on the provision of the supply opening, surplus opening and recovery opening and toner replenishment port in the development region as in modified example 3 is not restricted to an upper positioning of the developer supply conveyance path and, accordingly, a lower positioning of the developer recovery conveyance path as shown in FIG. 10 and FIG. 11 is possible. Conversely, in a development apparatus based on the upper arrangement of the developer recovery conveyance path and the lower arrangement of the developer supply conveyance path, similarly to modified example 3, the supply opening, surplus opening, recovery opening and toner replenishment port can be arranged on the inner side in the width of the development roller in the axial direction. As a result, the length of the three developer conveyance screws can be set shorter than the length in the axial direction of the development roller and, accordingly, a space saving of the development apparatus can be achieved.

As is described above, in the development apparatus 4 of modified example 3, by setting the length of the three developer conveyance screws equal to or less than the length in the axial direction of the development roller 5 and setting the openings that link the developer conveyance paths within the development region width α, a reduction in size of the development apparatus can be achieved.

In addition, by provision of the toner replenishment port 95 for replenishment of new toner or the toner density sensor 127 for detecting this in the development region width α, a reduction in size of the development apparatus 4 or an image forming apparatus comprising the same can be achieved.

By provision of developer conveyance paths with separate functions for the supply, recovery and agitation of the developer, the generation of image irregularities can be suppressed even when an image of large surface area is being continuously printed using a high density recording method or color recording method and, by achieving a space saving of the development apparatus 4, a reduction in size and space saving in an image forming apparatus comprising a plurality of development apparatuses such as for color recording or the like can be achieved.

MODIFIED EXAMPLE 4

A configuration in which the developer conveyance path of each of the recovery conveyance path 7, supply conveyance path 9 and agitation conveyance path 10 of modified example 3 are partitioned and in which a developer conveyance screw is provided for each of the three developer conveyance paths will be explained. The application of configuration such as the configuration of modified example 3 based on the provision of the supply opening, surplus opening, recovery opening and toner replenishment port in the development region width is not restricted to a development apparatus with three developer conveyance paths, and application in a development apparatus comprising four or more developer conveyance paths is possible. A modified example 4 comprising four developer conveyance paths will be hereinafter explained.

A development apparatus described by FIG. 9 and FIG. 10 of Japanese Unexamined Patent Application No. 2001-290368 constitutes an example of a development apparatus comprising four developer conveyance paths that comprises two agitation conveyance paths with partition members partitioning the space between each of the four developer conveyance paths. This development apparatus, in which the direction of conveyance of the developer in the recovery conveyance path is the direction opposing the direction of conveyance of the developer in the supply conveyance path, comprises a first agitation conveyance path to which recovery developer that has arrived at the furthermost downstream side in the direction of conveyance of the recovery conveyance path is supplied by way of a recovery opening, and a second agitation conveyance path in which surplus developer that has arrived at the furthermost downstream side in the direction of conveyance of the supply conveyance path is supplied by way of a surplus opening.

In modified example 4 having application in a development apparatus such as this, the first agitation conveyance path conveys the developer in the reverse direction to the recovery conveyance path and in the same direction as the supply conveyance path, and the second agitation conveyance path conveys the developer in the reverse direction to the first agitation conveyance path and supply conveyance path. In addition, the first agitation conveyance path comprises a toner replenishment port, and the developer that has arrived at the furthermost downstream side in the direction of conveyance of the first agitation conveyance path is supplied to the second agitation conveyance path in the same way as the surplus developer. The developer supplied to the second agitation conveyance path that has arrived at the furthermost downstream side in the direction of conveyance is supplied to the supply conveyance path through the supply opening. By provision of the first agitation conveyance path comprising the toner replenishment port and recovery opening separate to the second agitation conveyance path comprising a surplus opening and, following agitation of the developer of lowered toner density and the replenished toner, the supply thereof together with the surplus developer to the second agitation conveyance path, agitation of the two-component developer can be more reliably ensured. The opening of the partition member between the first agitation conveyance path and second agitation conveyance path through which the developer that has arrived at the furthermost downstream side in the direction of conveyance of the first agitation conveyance path is supplied to the second agitation conveyance path is referred to as the agitation opening.

In the development apparatus of the modified example 4, by the provision of a supply opening, surplus opening, recovery opening, toner replenishment port and agitation opening in the development region width each of the four developer conveyance paths can be set shorter and a space saving of the development apparatus can be achieved.

By setting of the four developer conveyance paths and the openings and developer conveyance members which should be provided for each of the four developer conveyance paths within the imaging region width in this way, a reduction in size of the development apparatus and the image forming apparatus can be achieved. Because of the large cross-sectional area and the large space occupied by the development apparatus of a development apparatus comprising four developer conveyance paths, a development apparatus configured from three developer conveyance paths such as the development apparatus 4 of modified example 3 in which a reduction in size thereof can be achieved without the problem of image irregularity occurring is the most preferred configuration.

MODIFIED EXAMPLE 5

This embodiment of the development apparatus 4 constitutes a configuration in which the supply conveyance path 9 is provided above the agitation conveyance path 10 and recovery conveyance path 7. The development apparatus 4 in which the characterizing elements of this embodiment are applicable is not restricted to this configuration. As a modified example 5, a development apparatus in which three developer conveyance paths of a supply conveyance path 9, agitation conveyance path 10 and recovery conveyance path 7 is provided at approximately the same height will be hereinafter described. Apart from the shape of the development apparatus 4 the configuration thereof is common to the development apparatus 4 of the embodiment and, accordingly, only the points of difference will be explained.

Figure 12:
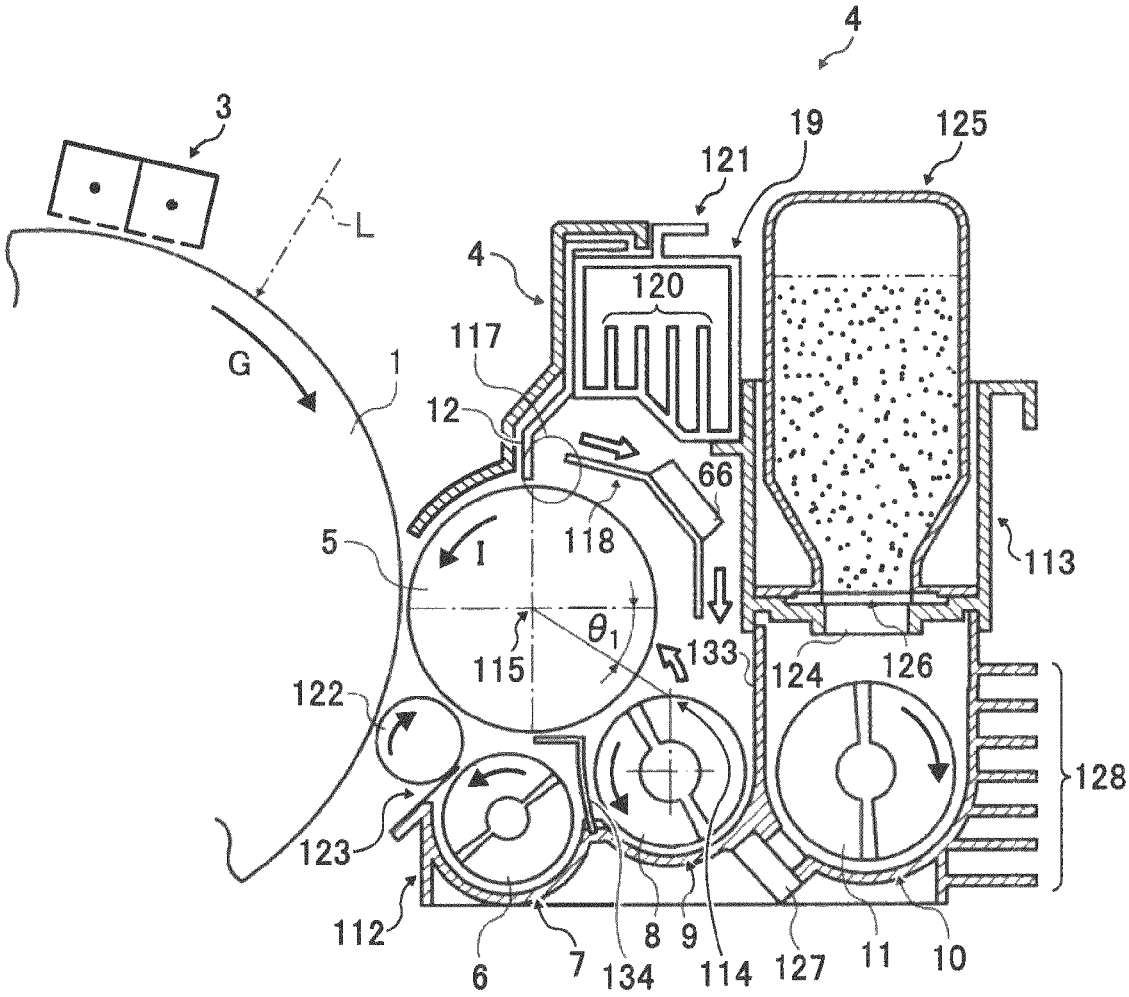
FIG. 12 is an explanatory diagram showing the schematic configuration of a development apparatus and a photosensitive body pertaining to a modified example 5 thereof.

FIG. 12 schematically shows the configuration of the development apparatus 4 pertaining to modified example 5.

While the photosensitive body 1 as shown in FIG. 12 is being rotated in the direction of the arrow G in the diagram, the surface thereof is charged by a scorotron charger 3. Toner is supplied from the development apparatus 4 to the latent image on which an electrostatic latent image has been formed by a laser light L irradiated by the exposure device not shown in the diagram forming a toner image on the surface of the charged photosensitive body 1.

The development apparatus 4 comprises a development roller 5 serving as a developer carrier that, while being surface moved in the direction of the arrow I in the diagram, supplies toner for developing a latent image on the surface of the photosensitive body 1. In addition, the apparatus comprises a supply screw 8 serving as a developer supply conveyance member that, while supplying developer to the development roller 5, conveys developer in the rear side direction of FIG. 12.

A development doctor 12 serving as a developer regulating member for regulating the developer supplied to the development roller 5 to a thickness suitable for development is provided on the downstream side in the direction of surface movement of the development roller 5 from an opposing part to the supply screw 8.

A recovery screw 6 serving as a developer recovery conveyance member for recovering the developer that has been used for development and that has passed the development unit and conveying the recovery developer in the same direction as the supply screw 8 is provided on the downstream side in the direction of surface movement of the development roller 5 from the development unit which constitutes an opposing part to the photosensitive body 1. The supply conveyance path 9 serving as a developer supply conveyance path that comprises the supply screw 8 and the recovery conveyance path 7 serving as the developer recovery conveyance path that comprises the recovery screw 6 are arranged in parallel below the development roller 5. The two conveyance paths between the supply conveyance path 9 and recovery conveyance path 7 are partitioned by a second partition wall 134 serving as a partition member.

An agitation conveyance path 10 serving as the developer agitation conveyance path is provided in the development apparatus 4 in parallel with the supply conveyance path 9 in the opposing side of the recovery conveyance path 7. The agitation conveyance path 10 comprises an agitation screw 11 serving as a developer agitation conveyance member that, while agitating the developer, conveys it in the reverse direction to the supply screw 8 which is to the front side in the diagram. The supply conveyance path 9 and agitation conveyance path 10 are partitioned by a first partition wall 133 serving as a partition member. The two ends in the front side and rear side in the diagram of the first partition wall 133 link the supply conveyance path 9 and agitation conveyance path 10. The surplus developer supplied to the supply conveyance path 9 that has not been employed for development and has been conveyed to the downstream end in the direction of conveyance of the supply conveyance path 9 and the recovery developer conveyed to the downstream end in the direction of conveyance of the recovery conveyance path 7 by the recovery screw 6 are supplied to the agitation conveyance path 10. The agitation conveyance path 10 agitates the supplied surplus developer and recovery developer and conveys it to the downstream side in the direction of conveyance of the agitation screw 11. The developer is supplied through the supply opening provided in the first partition wall 133 into the supply conveyance path 9 on the upstream side in the direction of conveyance of the supply screw 8.

An opening which links the supply conveyance path 9 and recovery conveyance path 7 is formed in the second partition wall 134 in the end in the furthermost downstream side in the direction of conveyance of the recovery screw 6 which is to the rear side in the diagram. The three conveyance paths are linked at the downstream end in the direction of conveyance of the recovery screw 6, the downstream end in the direction of conveyance of the supply screw 8, and the upstream end in the direction of conveyance of the agitation screw 11.

The recovery developer conveyed to the downstream end in the direction of conveyance of the recovery conveyance path 7 is transported to the supply conveyance path 9. In addition, the recovery developer and the developer not supplied to the development roller 5 that is conveyed by the supply screw 8 are transported to the linked agitation conveyance path 10.

In the agitation conveyance path 10, the recovery developer, surplus developer and toner replenished in accordance with need by a transport unit are conveyed while being agitated by the agitation screw 11 in the direction opposing the developer of the recovery conveyance path 7 and supply conveyance path 9. The agitated developer is transported to the upstream side in the direction of conveyance of the supply conveyance path 9 linked at the downstream side in the direction of conveyance. A toner density sensor 127 is provided below the agitation conveyance path 10, and a toner replenishment controller (not shown in the diagram) is operated on the basis of output from the sensor to replenish toner from a toner bottle not shown in the diagram to the transport unit.

The casing of the development apparatus 4 is configured from an integrally molded lower casing 112 and upper casing 113 top and bottom separated by axis parts of the three conveyance screws. The first partition wall 133 constitutes a part of the lower casing 112, and the second partition wall 134, which is supported on the upper casing 113, is coordinated with the lower casing 112.

As the toner replenishment controller described above a system in which a known monopump is employed can be adopted. This system is advantageous from the viewpoint of space distribution within the inner part of the image forming apparatus because of the minimal restrictions to the positional arrangement of the toner cartridges. In addition, toner can be replenished at any required time and, accordingly, there is no need for the provision of a large toner reservoir space in the development apparatus 4 and, to that end, a reduction in size of the development apparatus 4 is achieved.

As shown in FIG. 12, a screw apex 114 of the supply screw 8 that constitutes the uppermost part of the developer supply conveyance member is arranged below the revolving center 115 of the development roller 5. In the development apparatus 4, the angle $\theta_1$ between a line connecting the revolving center 115 and screw apex 114 of the development roller 5 and a parallel straight line passing through the revolving center 115 is set at 30[°]. The angle $\theta_1$ is affected by the diameter of the supply screw 8 and, from the viewpoint of the layout and reduction in size of the development apparatus, it is preferably set between 10[°] and 40[°].

The supply of developer to the development roller 5 occurs as a result of attraction of the carrier in the developer to a magnetic pole provided in the development roller 5. By arrangement of the screw apex 114 so that it is below the revolving center 115 of the development roller 5 as described above, the magnitude of the magnetic force contributes to the quantity of the developer that is supplied free of any effect of dead weight of the developer on the quantity of developer supplied to the development roller 5. As a result, because supply from the upper part of the developer conveyed by the supply conveyance path 9 is ensured, an appropriate quantity of developer can be supplied to the development roller 5 even if the volume of developer in the supply conveyance path 9 in the direction of conveyance of the supply screw 8 is non-uniform.

In a conventional development apparatus in which the three developer conveyance paths are provided at the same height, the supply opening through which the developer is delivered to the supply conveyance path 9 from the agitation carry path 10 is provided on the outer side of the development region width. As a result, the agitation carry path 10 and supply conveyance path 9 form a state in which the end part on the upstream side in the direction of conveyance of the supply conveyance path 9 juts out comparatively to the development roller 5 and recovery conveyance path 7.

Because the supply opening is provided in the development region width in the development apparatus 4 of the modified example 5, the jutting-out section of the agitation carry path 10 and supply conveyance path 9 comparatively to the development roller 5 and recovery conveyance path 7 are removed and a space saving of the development apparatus 4 can be achieved.

By provision of the three developer conveyance paths at the same height there is no need for the developer to be lifted up in the developer conveyance path and, accordingly, the stress on the developer can be reduced. As a result, deterioration of the developer can be suppressed and a stable image quality can be maintained.

A configuration of the embodiment and modified examples 1 to 5 thereof in which image density irregularities are prevented and in which a reduction in size of the development apparatus is possible will be hereinafter explained. While the best effect is able to be produced in the case where the developer used in these developer apparatuses combines a commonly used magnetic carrier and non-magnetic carrier, there are no particular restrictions to the developer to be used and application in other development apparatuses that use two-component developers in which, for example, a magnetic carrier and magnetic toner are combined is possible.

According to the embodiment described above, because the supply opening 91 through which developer is delivered from the downstream end in the direction of conveyance of the agitation carry path 10 to the upstream end in the direction of conveyance of the supply conveyance path 9 and the surplus opening 92 through which developer is delivered from the downstream end of the supply conveyance path 9 to the upstream end in the direction of conveyance of the agitation carry path 10 are provided in the development region width $\alpha$, a space saving of the upper part of the developer 4 can be achieved and a space saving of the development apparatus 4 as a whole can be achieved compared with the conventional development apparatus 4.

In addition, by provision of a toner replenishment port 95 in the free space afforded by the provision of the surplus opening 92 in the development region width $\alpha$, a reduction in size of the development apparatus 4 can be achieved.

In addition, a more efficient agitation of the developer can be implemented by replenishing toner from above the recovery opening 93 which constitutes the delivery part for the developer from the recovery conveyance path 7 to the agitation carry path 10.

In addition, because the agitation carry path 10 and recovery conveyance path 7 are provided at an approximately identical height and the supply conveyance path 9 is provided so as to be positioned above the other two developer conveyance paths, compared to an arrangement in which the agitation conveyance path 10, recovery conveyance path 7 and supply conveyance path 9 are provided in parallel at the same height, a space saving in the horizontal direction of the development apparatus 4 can be achieved.

In addition, because the supply conveyance path 9 is provided diagonally above the agitation conveyance path 10, the delivery of the developer from the agitation carry path 10 to the supply conveyance path 9 can be more efficiently implemented.

In addition, by provision of a development apparatus 4 serving as development means for a printer unit 100 of a copier serving as an image forming apparatus, a space saving of space of the apparatus as a whole can be achieved.

In addition, as in development apparatus 4 of modified example 1, because the surplus opening 92 through which developer is delivered from the downstream end of the supply conveyance path 9 to the upstream end in the direction of conveyance of the agitation carry path 10 is provided in the development region width α, a space saving of the upper part of the development apparatus 4 can be achieved and a space saving of the development apparatus 4 as a whole can be achieved compared with a conventional development apparatus 4. In addition, as in development apparatus 4 of modified example 2, because a supply opening 91 through which developer is delivered from the downstream end in the direction of conveyance of the agitation carry path 10 to the upstream end in the direction of conveyance of the supply conveyance path 9 is provided in the development region width α, compared to the conventional development apparatus 4, a space saving of the upper part of the development apparatus 4 can be achieved, and a space saving of the development apparatus 4 as a whole can be achieved.

In addition, as in modified example 3 of the development apparatus, by provision of a recovery opening 93 of the end part on the downstream side of the recovery conveyance path 7 in the inner side of the width in the axial direction of the development roller 5, the recovery conveyance path 7 can be made shorter, and a space saving of the lower part of the development apparatus 4 can be achieved and a space saving of the development apparatus 4 as a whole can be achieved compared with the conventional development apparatus 4.

Furthermore, because the recovery opening 93 is provided in the development region width α, a space saving of the lower part of the development apparatus 4 can be achieved and a space saving of the development apparatus 4 as a whole can be achieved compared with a conventional development apparatus 4.

In addition, by setting the length of the recovery screw 6 in the direction parallel to the axial direction of the development roller 5 equal to or less than the length in the axial direction of the development roller 5, the agitation carry path 10 can be set shorter, a space saving of the lower part of the development apparatus 4 can be achieved, and a space saving of the development apparatus 4 as a whole can be achieved.

In addition, by provision of the toner replenishment port 95 in the inner side of the width in the axial direction of the development roller 5, the agitation carry path 10 serving as a developer conveyance path in which the toner replenishment port 95 is provided can be shortened, a space saving of the lower part of the development apparatus 4 can be achieved, and a space saving of the development apparatus 4 as a whole can be achieved compared with the development apparatus 4.

Furthermore, because the toner replenishment port 95 is provided in the development region width α, a space saving of the lower part of the development apparatus 4 can be achieved and a space saving of the development apparatus 4 as a whole can be achieved compared with the conventional development apparatus 4.

In addition, the developer is able to be circulated in a development apparatus 4 comprising three carry screws by conveying of the developer by the recovery screw 6 in the same direction as the supply screw 8 along the axial direction of the development roller 5, and by conveying of the developer by the agitation screw 11 in the reverse direction to the supply screw 8 while it is being agitated along the axial direction of the development roller 5.

In addition, by arrangement in the inner part in the development roller 5 of a magnetic roller serving as magnetic field generation means with a plurality of magnetic poles the developer can be carried on a sleeve member that forms the surface of the development roller 5, and by provision of a development doctor 12 which constitutes a developer regulating member a two-component developer conveyed on the sleeve member can be regulated to a constant quantity.

In addition, by forming of the clearance between the development doctor 12 and development roller 5 between the development region in which the photosensitive body 1 and development roller 5 are opposing and the supply conveyance path 9 as a slit-shaped opening, and forming of the clearance between with the surface of the development roller 5 and the casing that forms the recovery conveyance path between the developer region and recovery conveyance path 7 as a slit-shaped opening, scattering of the developer through the openings of the casing of the development apparatus 4 can be suppressed.

In addition, by employing screw members configured from a spiral propeller part and axis part as the developer supply conveyance member, developer recovery conveyance member and developer agitation conveyance member, the developer can be more efficiently conveyed.

In addition, by provision of a toner density sensor 127 serving as toner density detection means for detecting toner density of the two-component developer, the usage state of the toner in the developer in the development apparatus 4 can be detected.

In addition, because a toner replenishment device 129 serving as toner replenishment means for replenishing toner to the agitation carry path 10 of the developer conveyance paths, and toner replenishment control means as toner replenishment quantity control means for regulating the replenishment quantity of toner by the toner replenishment device 129 in accordance with the detected result of the toner density sensor 127 are provided, the toner density of the developer in the development apparatus 4 can be maintained in the appropriate state.

In addition, because a casing forming the agitation conveying path 10 is formed so as to surround the agitation screw 11 in a shape that follows the shape of the agitation screw, conveyance from the agitation conveyance path 10 to the supply conveyance path 9 through the supply opening 91 can be more efficiently performed.

In addition, as in modified example 5 of the development apparatus 4, by provision of the recovery conveyance path 7, agitation carry path 10 and supply conveyance path 9 at approximately the same height, the stress on the developer can be lessened and an increase in the lifespan of the developer can be achieved.

The merits of the present invention described above are outlined below:

(1) By provision in the developer region width of at least one partition member opening of the openings that link the supply conveyance path and agitation conveyance path with the end part on the upstream side and the end part on the downstream side of the supply conveyance path, the supply conveyance path can be made shorter.

(2) An excellent effect in terms of facilitating a reduction in the space occupied by the supply conveyance path and a reduction in size of the apparatus can be achieved by shortening of the supply conveyance path.

(3) By provision in the inner side of the width in the axial direction of the developer carrier of the opening part of the partition member that links the agitation conveyance path with the recovery conveyance path of the end part on the downstream side of the recovery conveyance path, the recovery conveyance path can be shortened.

(4) An excellent effect in terms of facilitating a reduction in the space occupied by the recovery conveyance path and a reduction in size of the apparatus can be achieved by shortening of the recovery conveyance path.

(5) By provision of the toner replenishment port in the inner side of the width in the axial direction of the developer carrier, the need for the length of the developer conveyance path comprising the toner replenishment port in the direction of conveyance to be set longer by the length of the toner replenishment port is eliminated. As a result, the length in the direction of conveyance of the developer conveyance path comprising the toner replenishment port can be shortened.

(6) An excellent effect in terms of facilitating a reduction in the space occupied by the developer conveyance path and a reduction in size of the apparatus can be achieved by shortening of the developer conveyance path comprising the toner replenishment port.

Various modifications will become possible for those skilled in the art after receiving the teachings of the present disclosure without departing from the scope thereof.

What is claimed is:

1. A development apparatus comprising:

a developer carrier that rotates with a two-component developer including a magnetic carrier and toner carried on a surface thereof to supply toner for developing a latent image on a surface of a latent image carrier at a location opposing said latent image carrier;

a developer supply conveyance path which conveys said two-component developer along an axial direction of said developer carrier, the developer supply conveyance path including a developer supply conveyance member for supplying said two-component developer to said developer carrier;

a developer recovery conveyance path including a developer recovery conveyance member for conveying said two-component developer recovered from said developer carrier after having passed through a location opposing said latent image carrier, along the axial direction of said developer carrier and in a same direction as said developer supply conveyance member; and a developer agitation conveyance path to which a surplus developer not employed for development and conveyed to a furthermost downstream side in a direction of conveyance of said developer supply conveyance path and a recovery developer recovered from said developer carrier and conveyed to a furthermost downstream side in a direction of conveyance of said developer recovery conveyance path are supplied, the developer agitation conveyance path including a developer agitation conveyance member for, while agitating said surplus developer and said recovery developer, conveying said surplus developer and said recovery developer along the axial direction of said developer carrier in a reverse direction to said developer supply conveyance member to supply an agitated agitation developer to said developer supply conveyance path, wherein three developer conveyance paths including said developer recovery conveyance path, said developer supply conveyance path and said developer agitation conveyance path are partitioned by respective partition members and toner is replenished to said developer conveyance paths, wherein at least one of an opening of said partition member on the downstream side in the direction of conveyance of said developer supply conveyance path with said developer agitation conveyance path, through which said surplus developer is delivered, and an opening of said partition member on the downstream side in the direction of conveyance of said developer agitation conveyance path with said developer supply conveyance path, through which said agitation developer is delivered, is provided within a development region width which is a width in said axial direction of a development region in which said developer carrier supplies toner to said latent image carrier, and wherein a toner replenishment part where toner is replenished to said developer conveyance paths is either disposed at a furthermost upstream side of said developer agitation conveyance path or at a furthermost downstream side of said developer recovery conveyance path, said toner replenishment part being provided on an outer side of said development region width.

2. The development apparatus as claimed in claim 1, wherein the opening of said partition member on the downstream side in the direction of conveyance of said developer supply conveyance path with said developer agitation conveyance path, and the opening of said partition member on the downstream side in the direction of conveyance of said developer agitation conveyance path with said developer supply conveyance path are provided within said development region width.

3. The development apparatus as claimed in claim 1, further comprising magnetic field generation means including a plurality of magnetic poles arranged in an inner part of said developer carrier, and a developer regulating member for regulating the two-component developer carried on the surface of said developer carrier to a fixed quantity.

4. The development apparatus as claimed in claim 3, wherein a slit-shaped opening is formed by a clearance between the surface of said developer carrier and said developer regulating member, between said developer supply conveyance path and said development region in which said latent image carrier and said developer carrier are opposing, and a slit-shaped opening is formed by a clearance between the surface of said developer carrier and a casing forming said developer recovery conveyance path, between said development region and said developer recovery conveyance path.

5. The development apparatus as claimed in claim 1, wherein said developer supply conveyance member, said developer recovery conveyance member and said developer agitation conveyance member are screw members formed from spiral propeller parts and axial parts arranged in parallel in said axial direction of said developer carrier.

6. The development apparatus as claimed in claim 1, further comprising toner density detection means for detecting a mixture ratio of said magnetic carrier and toner of said two-component developer in said developer conveyance paths.

7. The development apparatus as claimed in claim 6, further comprising toner replenishment means for replenishing toner to said developer conveyance paths, and toner replenishment quantity control means for controlling a quantity of toner replenished by said toner replenishment means in accordance with a detected result of said toner density detection means.

8. The development apparatus as claimed in claim 1, wherein said developer agitation conveyance path is provided at approximately a same height as said developer recovery conveyance path, and said developer supply conveyance path is positioned above said developer agitation conveyance path and said developer recovery conveyance path.

9. The development apparatus as claimed in claim 8, wherein said developer supply conveyance path is provided diagonally above said developer agitation conveyance path.

10. The development apparatus as claimed in claim 9, wherein a casing forming said developer agitation conveyance path surrounds said developer agitation conveyance member in a shape that follows a shape of said developer agitation conveyance member.

11. The development apparatus as claimed in claim 1, wherein said developer supply conveyance path, said developer agitation conveyance path and said developer recovery conveyance path are provided at approximately the same height.

12. An image forming apparatus comprising:

at least a latent image carrier;

charging means for charging the surface of said latent image carrier;

latent image forming means for forming an electrostatic latent image on said image carrier; and development means for developing said electrostatic latent image to produce a toner image, said development means comprising:

a developer carrier that rotates with a two-component developer including a magnetic carrier and toner carried on a surface thereof to supply toner for developing a latent image on a surface of said latent image carrier at a location opposing said latent image carrier;

a developer supply conveyance path which conveys said two-component developer along an axial direction of said developer carrier, the developer supply conveyance path including a developer supply conveyance member for supplying said two-component developer to said developer carrier;

a developer recovery conveyance path including a developer recovery conveyance member for conveying said two-component developer recovered from said developer carrier after having passed through a location opposing said latent image carrier, along the axial direction of said developer carrier and in a same direction as said developer supply conveyance member; and a developer agitation conveyance path to which a surplus developer not employed for development and conveyed to a furthermost downstream side in a direction of conveyance of said developer supply conveyance path and a recovery developer recovered from said developer carrier and conveyed to a furthermost downstream side in a direction of conveyance of said developer recovery conveyance path are supplied, the developer agitation conveyance path including a developer agitation conveyance member for, while agitating said surplus developer and said recovery developer, conveying said surplus developer and said recovery developer along the axial direction of said developer carrier in a reverse direction to said developer supply conveyance member to supply an agitated agitation developer to said developer supply conveyance path, wherein three developer conveyance paths including said developer recovery conveyance path, said developer supply conveyance path and said developer agitation conveyance path are partitioned by respective partition members and toner is replenished to said developer conveyance paths, wherein at least one of an opening of said partition member on the downstream side in the direction of conveyance of said developer supply conveyance path with said developer agitation conveyance path, through which said surplus developer is delivered, and an opening of said partition member on the downstream side in the direction of conveyance of said developer agitation conveyance path with said developer supply conveyance path, through which said agitation developer is delivered, is provided within a development region width which is a width in said axial direction of a development region in which said developer carrier supplies toner to said latent image carrier, and wherein a toner replenishment part where toner is replenished to said developer conveyance paths is disposed substantially directly above a part where said two-component developer is delivered from said developer recovery conveyance path to said developer agitation conveyance path, said toner replenishment part being provided on an outer side of said development region width.

13. An image forming apparatus comprising:

at least a latent image carrier;

charging means for charging the surface of said latent image carrier;

latent image forming means for forming an electrostatic latent image on said image carrier; and development means for developing said electrostatic latent image to produce a toner image, said development means comprising:

a developer carrier that rotates with a two-component developer including a magnetic carrier and toner carried on a surface thereof to supply toner for developing a latent image on a surface of said latent image carrier at a location opposing said latent image carrier;

a developer supply conveyance path which conveys said two-component developer along an axial direction of said developer carrier, the developer supply conveyance path including a developer supply conveyance member for supplying said two-component developer to said developer carrier;

a developer recovery conveyance path including a developer recovery conveyance member for conveying said two-component developer recovered from said developer carrier after having passed through a location opposing said latent image carrier, along the axial direction of said developer carrier and in a same direction as said developer supply conveyance member; and a developer agitation conveyance path to which a surplus developer not employed for development and conveyed to a furthermost downstream side in a direction of conveyance of said developer supply conveyance path and a recovery developer recovered from said developer carrier and conveyed to a furthermost downstream side in a direction of conveyance of said developer recovery conveyance path are supplied, the developer agitation conveyance path including a developer agitation conveyance member for, while agitating said surplus developer and said recovery developer, conveying said surplus developer and said recovery developer along the axial direction of said developer carrier in a reverse direction to said developer supply conveyance member to supply an agitated agitation developer to said developer supply conveyance path, wherein three developer conveyance paths including said developer recovery conveyance path, said developer supply conveyance path and said developer agitation conveyance path are partitioned by respective partition members and toner is replenished to said developer conveyance paths, wherein at least one of an opening of said partition member on the downstream side in the direction of conveyance of said developer supply conveyance path with said developer agitation conveyance path, through which said surplus developer is delivered, and an opening of said partition member on the downstream side in the direction of conveyance of said developer agitation conveyance path with said developer supply conveyance path, through which said agitation developer is delivered, is provided within a development region width which is a width in said axial direction of a development region in which said developer carrier supplies toner to said latent image carrier, and wherein a toner replenishment part where toner is replenished to said developer conveyance paths is either disposed at a furthermost upstream side of said developer agitation conveyance path or at a furthermost downstream side of said developer recovery conveyance path, said toner replenishment part being provided on an outer side of said development region width.

* * * * *